US006431699B2

(12) United States Patent
Shihoh et al.

(10) Patent No.: US 6,431,699 B2
(45) Date of Patent: Aug. 13, 2002

(54) INK TANK COUPLING METHOD, INK JET RECORDING APPARATUS, AND INK TANK

(75) Inventors: Makoto Shihoh, Yokohama; Osamu Sato, Chigasaki; Masatoshi Ikkatai, Yokohama; Kyoto Miyazaki, Kawasaki; Yoshimasa Araki, Kawaguchi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 09/903,657

(22) Filed: Jul. 13, 2001

Related U.S. Application Data

(62) Division of application No. 09/231,252, filed on Jan. 15, 1999, now Pat. No. 6,293,662.

(30) Foreign Application Priority Data

| | | |
|---|---|---|
| Jan. 19, 1998 | (JP) | 10-7507 |
| Feb. 5, 1998 | (JP) | 10-24368 |
| Mar. 18, 1998 | (JP) | 10-68585 |
| Dec. 21, 1998 | (JP) | 10-362450 |
| Dec. 22, 1998 | (JP) | 10-364761 |

(51) Int. Cl.[7] ..... B41J 2/175
(52) U.S. Cl. ..... 347/86
(58) Field of Search ..... 347/85, 86, 87, 347/49; 220/628, 635; 222/83

(56) References Cited

U.S. PATENT DOCUMENTS

| | | | | |
|---|---|---|---|---|
| 4,736,213 A | | 4/1988 | Platt et al. | 347/49 |
| 5,168,291 A | | 12/1992 | Hramatsu et al. | 347/19 |
| 5,428,378 A | * | 6/1995 | Murata et al. | 347/19 |
| 5,550,570 A | | 8/1996 | Kurata et al. | 347/49 |
| 5,619,239 A | | 4/1997 | Kotaki et al. | 347/86 |
| 5,751,319 A | * | 5/1998 | Robertson et al. | 347/85 |
| 5,801,736 A | | 9/1998 | Ikkatai et al. | 347/86 |
| 5,841,453 A | * | 11/1998 | Sasaki | 347/86 |
| 6,042,224 A | * | 3/2000 | Oda et al. | 347/86 |
| 6,042,226 A | | 3/2000 | Therien | 347/92 |
| 6,074,042 A | * | 6/2000 | Gasvoda et al. | 347/50 |
| 6,109,480 A | * | 8/2000 | Monstrud et al. | 222/83 |
| 6,276,789 B1 | * | 8/2001 | Miyazawa et al. | 347/86 |
| 6,293,662 B1 | * | 9/2001 | Shihoh et al. | 347/86 |

FOREIGN PATENT DOCUMENTS

| | | |
|---|---|---|
| EP | 622234 | 11/1994 |
| EP | 715959 | 6/1996 |
| JP | 1-141750 | 6/1989 |
| JP | 9-76525 | 3/1997 |
| WO | 98/55324 | 12/1998 |

* cited by examiner

*Primary Examiner*—Michael Nghiem
(74) *Attorney, Agent, or Firm*—Fitzpatrick, Cella, Harper & Scinto

(57) ABSTRACT

An ink tank includes an ink containing portion for containing ink, a bottom surface provided with three projections for supporting the ink tank, an ink supply portion for leading ink out of the ink containing portion to the exterior a top surface opposing to said bottom surface, and a plurality of lateral surfaces adjacent to the bottom and top surfaces. The plurality of lateral surfaces include one set of opposing surfaces extended in a lengthwise direction of the ink tank. A grip portion is provided at one end of the ink tank in the lengthwise direction of insertion thereof. Two of the three projections are provided on the bottom surface in an opposed relation in areas near the opposing surfaces of the plurality of lateral surfaces, the ink supply portion being provided in an area of the top surface opposed to an area located on or within lines connecting the three projections.

9 Claims, 26 Drawing Sheets

INK TANK COUPLING METHOD, INK JET RECORDING APPARATUS, AND INK TANK

This application is a division of application Ser. No. 09/231,252, filed Jan. 15, 1999, now U.S. Pat. No. 6,293,662.

BACKGROUND OF THE INVENTION

1. Field of the Invention

The present invention relates to an ink tank coupling method for use with a liquid ejection recording apparatus in which a liquid such as ink is ejected to carry out recording, an ink jet recording apparatus, and an ink tank for use in the ink jet recording apparatus. More particularly, the present invention relates to an ink tank coupling method for use with a liquid ejection recording apparatus which is employed in an ink jet printing system consuming a large amount of ink, an ink jet recording apparatus, and a large-capacity ink tank mounted on the ink jet recording apparatus.

2. Description of the Related Art

An ink tank (liquid storing container) for use in an ink jet recording apparatus is constructed to be detachably attached to an ink tank unit, which serves as an ink tank receiving portion of the recording apparatus, in order that the ink tank can be easily replaced-when ink is exhausted. The ink tank has an ink supply port which is closed by a rubber plug to prevent leakage of ink when the ink tank is handled alone. The ink tank unit includes a hollow needle or the like which is provided in its connecting portion to the ink tank. By connecting the ink tank unit to the ink supply port of the ink tank, ink can be supplied from the ink tank.

Japanese Patent Laid-Open No. 1-141750, for example, discloses a detailed construction of an ink tank unit which enables such an ink tank to be mounted on an ink jet recording apparatus, and an ink tank coupling method. According to the known related art as disclosed in that publication, the ink tank has an ink supply port provided in its front portion taking in the direction in which the ink tank is inserted into the ink tank unit so that the direction in which the ink tank is inserted into the ink tank unit is the same as the direction in which the ink supply port of the ink tank is connected to an ink supply path in the ink jet recording apparatus. When coupling the ink tank unit and the ink tank with each other, positioning of the ink tank relative to the ink tank unit and insertion of the hollow needle into the ink supply port are effected with one action.

The direction in which the ink tank is inserted into the ink tank unit depends on the shape and size of the ink tank. In some cases, the ink tank is horizontally inserted into the ink tank unit as disclosed in the above-mentioned Japanese Patent Laid-Open No. 1-141750, and in other cases, the ink tank is ventrally inserted into the ink tank unit from above as disclosed in Japanese Patent Laid-Open No. 9-076525. In any case, the direction in which a needle is inserted is opposed to the direction in which the ink tank is inserted.

Meanwhile, in a large-sized ink jet recording apparatus having a high printing duty and consuming a large amount of ink, a large-capacity ink tank capable of containing an amount of ink, for example, not less than 200 cc, more preferably not less than 500 cc, is often employed to hold down the frequency of replacement of ink tanks.

With a container having such a large size, however, the following specific problems due to an increase of the container size arise in point of connection to an ink tank unit.

Specifically, because the container contains a large amount of liquid and the container including the liquid has large total weight, users sometimes cannot clearly recognize whether an ink supply needle is appropriately connected at the same time as upon the container being attached to the ink tank unit, including even the case that the needle and an ink supply port are shifted in positional relationship between them. As a result, an extra force is imposed on a coupled portion between the container and the ink supply unit due to a condition where the needle and the ink supply port are not positively connected to each other. This raises a risk that ink may leak from the coupled portion, or in the worst case, the coupled portion may be damaged; for example, the needle may be bent.

Also, because of the above-mentioned container having a large size, if an ink tank is designed to be positioned to a point remote from the coupled portion when attached to the recording apparatus, the container is required to be manufactured with high accuracy in order to realize positive coupling.

Particularly, in such a construction that the direction in which the needle is inserted is opposed to the direction in which the ink tank is inserted, if the ink tank is fixed offset from a predetermined position, an extra force is imposed on the coupled portion due to a condition where the needle and the ink supply port are not positively connected to each other, thus resulting in a risk that ink may leak from the coupled portion, or in the worst case, the coupled portion may be damaged; for example, the needle may be bent.

SUMMARY OF THE INVENTION

A first object of the present invention is to solve the problems set forth above, and to provide an ink tank coupling method, an ink jet recording apparatus, and an ink tank, by which position accuracy of a coupled portion between an ink tank and an ink tank unit is improved to enhance reliability of the coupling with a relatively simple construction, while allowing users to recognize the proper coupling of the ink tank.

A second object of the present invention is to, in addition to or apart from the above first object, provide an ink tank coupling method, an ink jet recording apparatus, and an ink tank, by which position accuracy of a coupled portion between an ink tank and an ink tank unit is improved to enhance reliability of the coupling with a relatively simple construction.

Still another object of the present invention is to, in addition to or apart from the above first and second objects, provide an ink tank which can protect an ink supply port against an external shock caused upon a drop so that the ink tank is more positively coupled to a recording apparatus capable of mounting the ink tank on it.

To achieve the above first object, the present invention provides an ink tank coupling method for an ink jet recording apparatus comprising a recording head for ejecting ink to carry out recording, an ink supply needle for supplying the ink to the recording head, and moving means for moving the ink supply needle to a predetermined position, the ink jet recording apparatus being able to detachably mount an ink tank containing ink supplied to the recording head, the method comprising a holding and fixing step of holding and fixing the ink tank to a predetermined position by releasing movement preventing means which prevents movement of the ink supply needle caused by the moving means, and pressing the ink tank to abut a reference surface with an operation of attaching the ink tank to the ink jet recording apparatus, and an ink supply needle inserting step of inserting the ink supply needle to the predetermined position in the ink tank by the moving means after the holding and fixing step.

Also, the present invention provides an ink jet recording apparatus comprising a recording head for ejecting ink to carry out recording, an ink supply needle for supplying the ink to the recording head, and moving means for moving the ink supply needle to a predetermined position, the ink jet recording apparatus being able to detachably mount an ink tank containing ink supplied to the recording head, wherein the ink jet recording apparatus further comprises a reference surface against which the ink tank is fixedly held, and movement preventing means for preventing movement of the ink supply needle caused by the moving means, the movement preventing means being released upon the ink tank being attached to the ink jet recording apparatus.

According to the ink tank coupling method and the ink jet recording apparatus set forth above, it is possible to avoid a risk that may injure users due to such a false operation as when any other ink tank than desired is inserted, and to keep the needle from being damaged. Further, since the needle is inserted after a coupling portion of the ink tank has been positioned, positional accuracy of coupling portions of the ink tank and an ink tank unit of the recording apparatus can be increased to improve reliability of the coupling, and users can recognize that the ink tank has been coupled to the ink tank unit.

The first object of the present invention can be achieved by the ink tank coupling method and the ink jet recording apparatus set forth above. In addition, the following specific advantages can be obtained by meeting more preferable conditions below.

One of the more preferable conditions is that a direction of insertion of the ink tank is substantially perpendicular to a direction of insertion of the ink supply needle. This feature provides an advantage that the insertion of the ink supply needle does not affect the ink tank in the direction of insertion of the ink tank in which the position of the ink tank is more likely to shift, and therefore more positive coupling is realized. Further, with the above feature, a connecting portion of the ink tank to the exterior can be disposed at the top of the ink tank, and ink leakage can be avoided effectively.

Also, by preventing wrong attachment of the ink tank before releasing the movement preventing means, the ink tank can be more reliably prevented from being attached falsely.

By providing at least two types of the movement preventing means in the holding and fixing step, the needle is avoided from being damaged inadvertently even if one of the movement preventing means should malfunction, and the movement preventing means can be constructed to have increased strength.

By urging the ink tank by the moving means in a direction to abut the reference surface, more positive coupling can be realized.

On the other hand, to achieve the above second object, the present invention provides an ink tank coupling method for an ink jet recording apparatus comprising a joint needle capable of being connected to an ink tank containing ink used for recording, and moving means for moving the joint needle to a predetermined position, the ink jet recording apparatus being able to detachably hold the ink tank provided with a projected portion for connection to the joint needle, the method comprising a pressing step of inserting the ink tank in a direction perpendicular to the direction in which the needle is moved by the moving means, and pressing the projected portion to abut a reference surface parallel to the direction of movement of the needle.

Also, the present invention provides an ink jet recording apparatus comprising a joint needle capable of being connected to an ink tank containing ink used for recording, moving means for moving the joint needle to a predetermined position, holding means being able to detachably hold the ink tank provided with a projected portion for connection to the joint needle, and a reference surface against which the projected portion is fixedly held, wherein a direction of movement of the joint needle caused by the moving means is perpendicular to a direction of insertion of the ink tank into the holding means, and is parallel to the reference surface.

According to the ink tank coupling method and the ink jet recording apparatus set forth above, since the direction of insertion of the ink tank is substantially perpendicular to the direction of insertion of the needle caused by the moving means, the insertion of the needle does not affect the ink tank in the direction of insertion of the ink tank in which the position of the ink tank is more likely to shift, and therefore more positive coupling is realized. Further, since a connecting portion of the ink tank to the exterior can be disposed at the top of the ink tank, ink leakage can be avoided effectively. Since the ink tank is positioned with the aid of the projected portion which serves as a coupling portion to the recording apparatus, it is possible to increase positional accuracy of the coupling portions of the ink tank and the ink tank unit and to improve reliability of the coupling by increasing accuracy of a part of the tank, i.e., the projected portion, rather than accuracy of the entire tank.

The second object of the present invention can be achieved by the ink tank coupling method and the ink jet recording apparatus set forth above. In addition, the following specific advantages can be obtained by meeting more preferable conditions below.

One of the more preferable conditions is that the reference surface comprises a first reference surface perpendicular to the direction of insertion of the ink tank, and a second reference surface perpendicular to the first reference surface, and the pressing step includes a first pressing step of pressing the projected portion to abut the first reference surface, and a second pressing step of pressing the projected portion to abut the second reference surface. This feature further increases the positional accuracy.

Further, when coupling an ink tank including a plurality of projected portions, one of the plurality of projected portions is pressed to abut the first reference surface, and at least two of the plurality of the projected portions are pressed to abut the second reference surface. With this feature, in an ink jet recording apparatus which employs inks of multiple colors, the ink tank can be prevented from wobbling in the direction of insertion thereof and more positive coupling can be realized without wasteful use of a space. In this connection, by constructing the holding means to include, as a pressing means, a click member for urging the projected portions which abuts the first reference surface, users can sense a more positive click feel and can more easily recognize that the ink tank has been positioned.

Moreover, the present invention provides an ink tank for use in the ink jet recording apparatus set forth above.

According to the present invention, in an ink tank including an ink containing portion for containing ink, the ink tank comprises a substantially cylindrical first projected portion having a communicating portion for communicating the ink containing portion with the exterior, and a substantially cylindrical second projected portion having a communicating portion for leading out the ink in the ink containing portion to the exterior, the first and second projected portions being both provided on a surface opposing to a bottom surface of the ink tank, a grip portion provided at a rear end of the ink tank in the direction of insertion thereof, and a vertical surface portion extending upward from the grip portion perpendicularly to the bottom surface of the ink tank in an opposed relation to the first and second projected portions, the second projected portion being provided in an area between the vertical surface portion and the first projected portion, the vertical surface portion having an upper end at a higher level from the bottom surface than end faces of the communicating portions of the first and second projected portions, the second projected portion being positioned at a level lower than a line connecting the upper end of the vertical surface portion and the end face of the communicating portion of the first projected portion.

With the ink tank set forth above, since the second projected portion for supplying the ink is positioned at a level lower than the line connecting the upper end of the vertical surface portion and the end face of the communicating portion of the first projected portion, the second projected portion is prevented from directly contacting the ground and is protected in the even of drop of ink tank. Therefore, an ink tank is provided which can be more reliably coupled to a recording apparatus capable of mounting the ink tank on it.

A desired construction for protecting the second projected portion more reliably can be obtained by providing a slope between the vertical surface portion and the surface opposing to the bottom surface, and a rib on the slope.

Further, by causing the moving means to urge the vertical surface portion of the ink tank in a direction to abut the reference surface, there is provided an ink tank which can be more positively coupled to the recording apparatus set forth above. Here, the communicating portion of the ink tank of the present invention may be formed as an opening beforehand, or may be sealed by a rubber plug or the like and then pierced by, e.g., an ink supply needle of an ink jet recording apparatus for communication.

According to another form of the present invention, in an ink tank including an ink containing portion for containing ink, the ink tank comprises a bottom surface provided with three projections for supporting the ink tank, an ink supply portion for leading out the ink in the ink containing portion to the exterior, a top surface opposing to the bottom surface, a plurality of lateral surfaces adjacent to the bottom surface and the top surface, the plurality of lateral surfaces including one set of opposing surfaces extended in a lengthwise direction of the ink tank, and a grip portion provided at one end of the ink tank in the lengthwise direction thereof insertion thereof, two of the three projections being provided on the bottom surface in an opposed relation in areas near the opposing surfaces of the plurality of lateral surfaces, the ink supply portion being provided in an area of the top surface opposing to an area locating on or within lines connecting the three projections.

With the ink tank set forth above, since the tank is supported by three projections, a force generated upon the insertion of the needle into the tank unit is borne by the projections rather than the entire bottom surface of the tank. It is hence possible to provide an ink tank which is less affected upon the insertion of the needle depending on product variations of ink tanks.

Note that the term "ink" used in this specification implies all kinds of liquids ejected from an ink jet recording head, and therefore includes, for example, a printing improvement liquid such as a treatment liquid used to improve permeation of ink into recording paper.

DESCRIPTION OF THE PREFERRED EMBODIMENTS

Preferred embodiments of the present invention will be described below with reference to the drawings.

Figure 1:
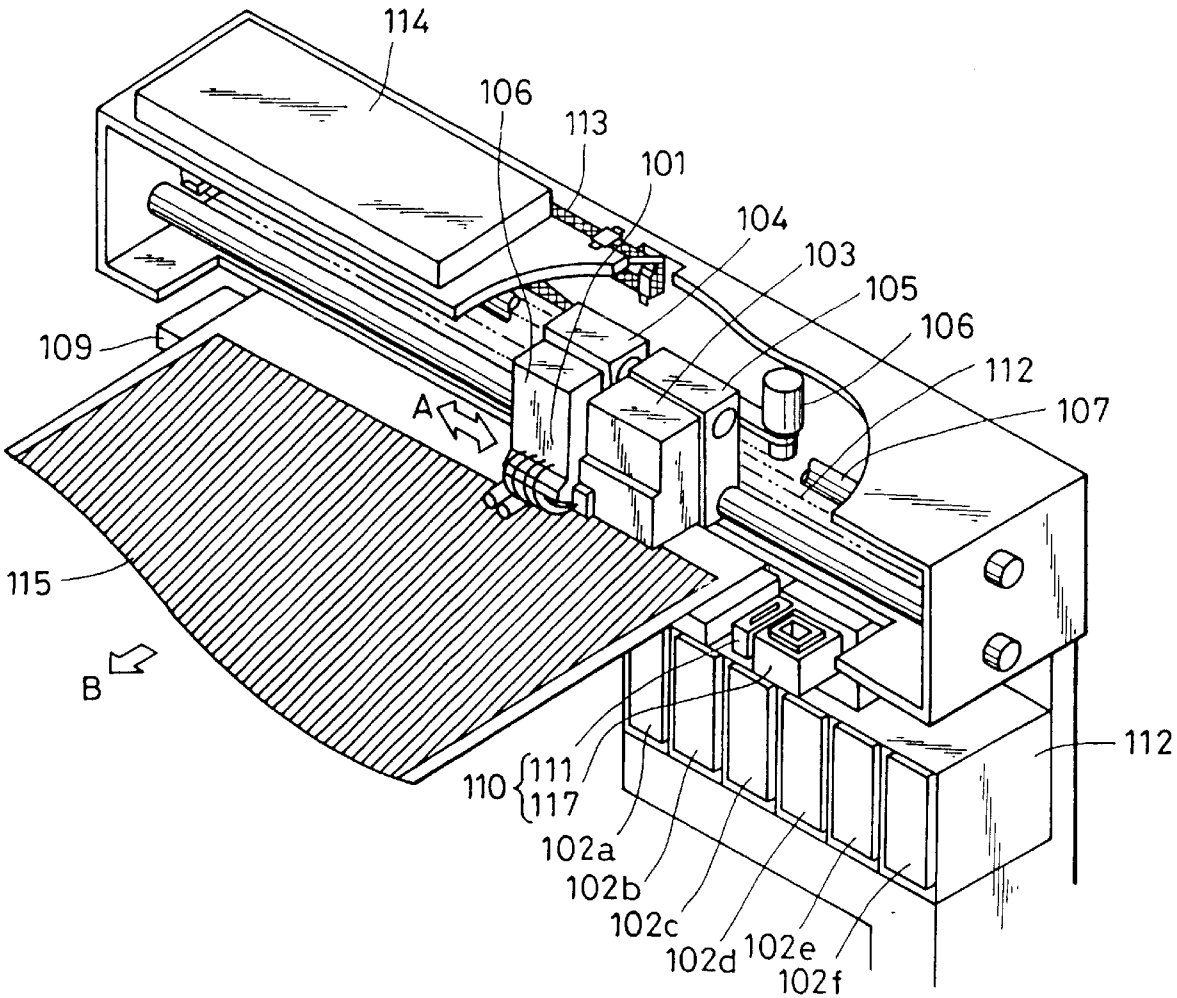
FIG. 1 is a perspective view showing an appearance of an ink jet recording apparatus as one embodiment of a liquid ejection recording apparatus to which the present invention is applicable.
Figure 2:
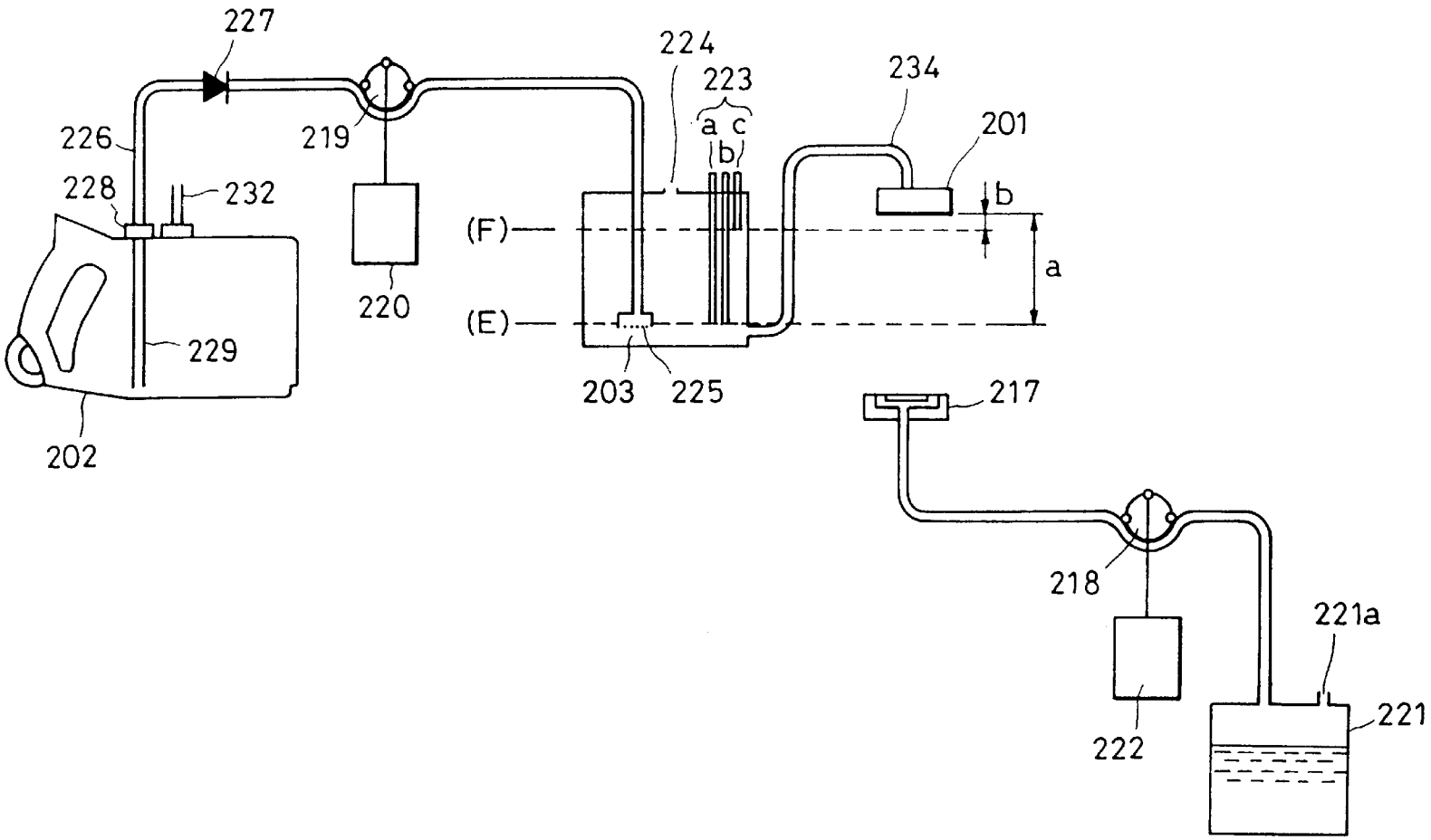
FIG. 2 is a schematic explanatory view showing one example of a liquid resupply system for use in the liquid ejection recording apparatus of FIG. 1.

First, one form of a construction of an ink jet recording apparatus, on which an ink tank unit of the present invention can be mounted, and an ink supply path therein will be described with reference to FIGS. 1 and 2. FIG. 1 is a perspective view showing an appearance of an ink jet recording apparatus as one embodiment of a liquid ejection recording apparatus to which the present invention is applicable, and FIG. 2 is a schematic explanatory view showing one example of a liquid resupply system for use in the liquid ejection recording apparatus of FIG. 1. Note that an ink tank unit and an ink tank, described later, according to the present invention are also of course applicable to other forms of liquid ejection recording apparatus rather than being limited to the illustrated embodiment.

As shown in FIG. 1, a head carriage 104 and a supply carriage 105 are fitted over two main scan rails 107, which are disposed parallel to each other, such that both the carriages are slidable in the direction of arrow A. An ejection head unit 101 for ejecting ink in accordance with a recording signal is mounted on the head carriage 104.

Corresponding to inks of six colors, i.e., deep cyan, light cyan, deep magenta, light magenta, yellow and black, the ejection head unit 101 has nozzles arranged in plural number for each color, and the nozzles are each provided with an electro-thermal transducer for generating thermal energy adapted for ejection of the ink. The ink is supplied to the interior of the ejection head unit 101 based on a capillary phenomenon developed in the nozzles. The ink forms a meniscus in a plane (referred to as a "nozzle plane" hereinafter) in which the nozzles of the ejection head unit 101 are opened, and the nozzles are kept filled with the-ink. Further, the ejection head unit 101 is covered by a head cover 106 along with a driving board for driving the ejection head unit 101. The driving board of the ejection head unit 101 is connected through a flat cable 113 to a board box 114 in which a control board and so forth for controlling operation of the entire recording apparatus are housed.

On the other hand, a sub-tank 103 for supplying ink to the ejection head unit 101 is mounted on the supply carriage 105. The interior of the sub-tank 103 is divided into six chambers corresponding to the inks of six colors in a one-to-one relation, and these chambers are connected by resin-made tubes to corresponding portions of the ejection head unit 101. Below the sub-tank 103, six main tanks (ink tanks) 102 for containing ink supplied to the sub-tank 103 are held in a main tank unit (ink tank unit) 120 described later. The detailed structure of the ink tank unit is omitted in FIG. 1.

The main tank 102 has a larger capacity than the sub-tank 103, and is able to contain 500–1000 $cm^3$ of ink in this embodiment. As with the sub-tanks 103, the main tanks 102 are also provided corresponding to the inks of six colors in a one-to-one relation, and are connected by resin-made tubes to the corresponding chambers of the sub-tank 103. Thus, the ink contained in the main tank 102 is supplied to the sub-tank 103 and held in it, followed by being supplied to the ejection head unit 101 from the sub-tank 103.

The head carriage 104 and the supply carriage 105 are each joined with a timing belt, and are reciprocally scanned in the direction of arrow A with the timing belt driven to run by a main scan motor 108. A platen 109 is provided in a position opposed to the nozzles of the ejection head unit 101. A sheet of recording paper 115 is advanced over the platen 109 in the direction of arrow B. The sheet of recording paper 115 is intermittently advanced at a predetermined pitch for each scan of the carriages, and ink is ejected from the ejection head unit 101 for recording while the sheet of recording paper 115 is advanced.

Further, at a position within an area in which the ejection head unit 101 is scanned, but outside an area in which recording is made on the sheet of recording paper 115, a head restoring system 110 for maintaining a good ink ejection characteristic of the ejection head unit 101. The head restoring system 110 includes a cap 117 for capping the ejection head unit 101, and a blade 111 for cleaning the nozzle plane of the ejection head unit 101. The position of the ejection head unit 101 where the unit 101 faces the cap 117 is called a home position.

Next, one embodiment of an ink path between the ink tank and the ejection head unit of the liquid ejection recording apparatus shown in FIG. 1, and a detailed construction of the ink path will be described with reference to FIG. 2. Although the ink jet recording apparatus of this embodiment employs inks of plural colors, as mentioned above, and the ink path is provided for each color, FIG. 2 shows the path of ink of one color because the ink path has the same construction for each color.

As shown in FIG. 2, a main tank (ink tank) 202 and a sub-tank 203 are connected to each other by a main tube 226. One end portion of the main tube 226 connected to the main tank 202 is provided with a hollow needle (not shown) like a syringe needle, and is connected to a rubber plug 228 of the main tank. An open-to-atmosphere pipe 232 is inserted into the main tank to make it open to the atmosphere, and the ink in the main tank can be led out through a tube 229 extending from the rubber plug 228.

The other end portion of the main tube 226 is inserted into the sub-tank 203, and a filter 225 for preventing ingress of foreign matters to the interior of the sub-tank 203 is attached to the tube end. The end of the main tube 226, which is inserted into the sub-tank 203, locates at a position lower than a level indicated by (E). Also, a one-way valve 227, which is opened only when ink flows from the main tank 202 to the sub-tank 203, is disposed in the main tube 226 so that the ink is prevented from flowing reversely from the sub-tank 203 to the main tank 202. A negative pressure generating pump 219 is disposed between the check valve and the sub-tank.

To detect an amount of ink remaining in the sub-tank 203, the sub-tank 203 is provided with an amount-of-remaining-ink sensor 223 which is made up of three electrode needles a, b, c inserted into the sub-tank 203 from an upper end thereof. Of the electrode needles a, b, c, the two electrode needles a, b are inserted such that their ends reach the level indicated by (E), while the remaining electrode needle c is inserted such that its end reaches a level indicated by (F). The amount of ink in the sub-tank 203 is detected by supplying a low-voltage current to each of the electrode needles a, b, c and detecting continuity between the electrode needles a, b, c through the ink. More specifically, if a surface level of the ink is lower than the level (E), continuity between the electrode needles a and b is not detected, whereupon ink is supplied from the main tank 202 to the sub-tank 203 as described later. If a surface level of the ink is higher than the level (F), continuity between the electrode needles a and c is detected, whereupon supply of ink to the sub-tank 203 is stopped.

Further, an atmosphere communicating hole 224 is provided in an upper portion of the sub-tank 203 at a position higher than the level indicated by (F).

A bottom portion of the sub-tank 203 and an ejection head unit 201 are connected to each other by a sub-tube 234. Thus, ink is supplied from the sub-tank 203 to the ejection head unit 201 based on a capillary phenomenon developed in nozzles of the ejection head unit 201. In this embodiment, the ejection head unit 201 is arranged such that a height a from the position indicated by (E) to the nozzle plane of the ejection head unit 201 is 50 mm, and a height b from the position indicated by (F) to the nozzle plane of the ejection head unit 201 is 10 mm. With this arrangement, ink in the ejection head unit 201 forms a meniscus in the nozzle plane and the nozzles are kept filled with the ink.

On the other hand, the sub-tube 234 is connected to the sub-tank 203 and the ejection head unit 201 at a position lower than the level indicated by (E).

The cap 217 for capping the ejection head unit 201 is connected to a waste ink tank 221 by a suction tube. The suction tube is associated with a suction pump 218. When the suction pump 218 is driven in a condition where the ejection head unit 201 is capped by the cap 217, ink in the ejection head unit 201 is sucked into the cap 217 and is drained to the waste ink tank 221 through the suction tube.

Incidentally, the suction pump 218 and the negative pressure generating pump 219 are tube pumps and driven by pump motors 222, 220, respectively.

In the construction described above, the liquid resupply operation is performed along with the recording operation. First, printing (recording) is carried out on a sheet of recording paper by ejecting ink from the ejection head unit 201 in accordance with a recording signal, while reciprocal scan of the ejection head unit 201 and feeding of the sheet of recording paper in units of pitch are repeated. During a period of printing, the suction pump 218 and the negative pressure generating pump 219 are held stopped.

When the ink in the sub-tank 203 is consumed and the surface level of the ink in the sub-tank 203 lowers than the level indicated by (E) with repetition of recording on sheets of recording paper, continuity between the electrode needles a and b of the amount-of-remaining-ink sensor 223 is lost, whereupon it is detected that the amount of ink remaining in the sub-tank has become small.

Upon discontinuity between the electrode needles a and b being detected, the recording carried out on a sheet of recording paper at that time is temporarily suspended, and the ejection head unit 201 is returned to the home position where the ejection head unit is capped by the cap 217. The negative pressure generating pump 219 is then driven to resupply the ink in the main tank 202 to the sub-tank 203.

At this time, since the ejection head unit 201 is capped, the ink is kept from returning from the ejection head unit 201 to the sub-tank 203. Also, when the ink in the main tank 202 is supplied to the sub-tank 203, foreign matters in the ink are removed by the filter 225 attached to the end of the main tube 226. Then, when the ink in the main tank 202 is exhausted, it is replaced by new one.

Next, an ink tank unit (main tank unit) receiving an ink tank (main tank) for a liquid ejection recording apparatus and the ink tank received in the ink tank unit, which are features of the present invention, will be described in connection with six embodiments below.

First Embodiment

FIGS. 3 to 7 are explanatory views of an ink tank unit (main tank unit) receiving an ink tank (main tank) for a liquid ejection recording apparatus and the ink tank received in the ink tank unit according to the first embodiment of the present invention.

Figure 3A:
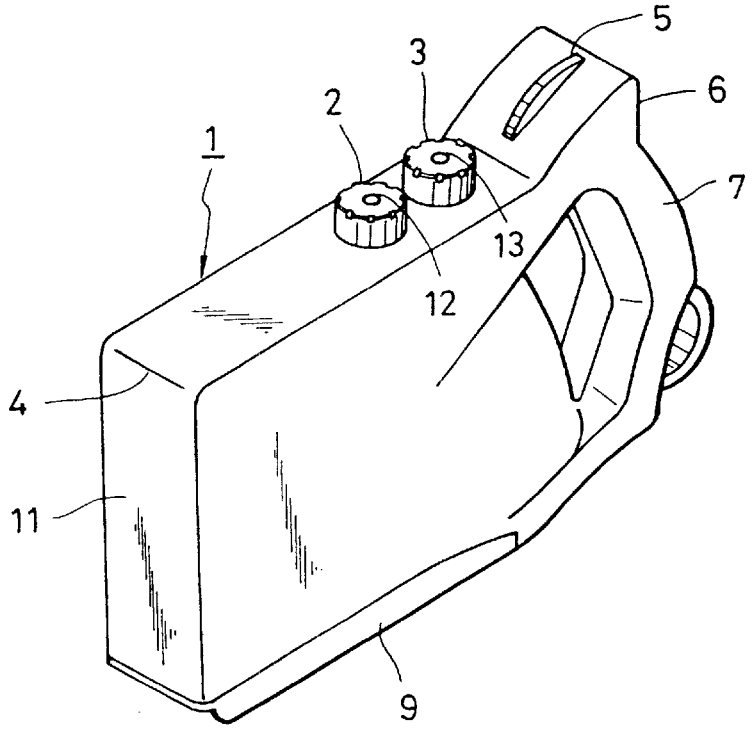
FIGS. 3A and 3B are three-dimensional perspective views of an ink tank according to a first embodiment of the present invention.
Figure 3B:
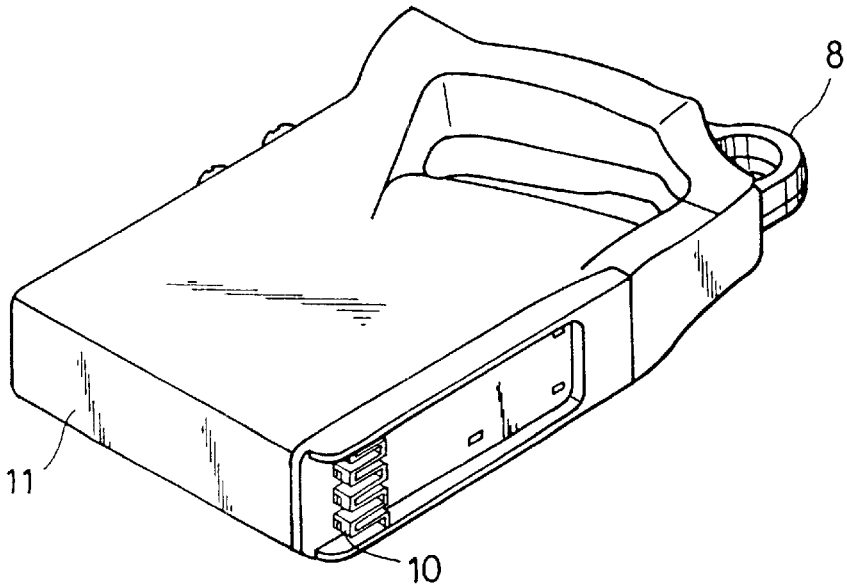

The ink tank attached to the ink tank unit of the present invention will be first described with reference to three-dimensional perspective views shown in FIGS. 3A and 3B. FIG. 3A is a three-dimensional perspective view of the ink tank in a state where a connecting portion of the ink tank to needles of the ink tank unit, described later, is positioned at the top (i.e., in a posture during use), and FIG. 3B is a three-dimensional perspective view for explaining a bottom surface of the ink tank.

A main tank 1 comprises a rigid housing 11 and can contain a liquid, such as ink, directly inside the housing 11. The main tank 1 includes a first cap 2 in the form of a first projected portion having an atmosphere communicating port 12 through which the atmosphere is introduced to the interior of the housing 11, a second cap 3 in the form of a second projected portion having an ink supply port 13 through which the liquid in the housing 11 is led out to the exterior, the first and second caps 2, 3 being provided on a top surface opposed to the bottom surface of the main tank on which a wrong attachment preventing member 9 is provided, and the wrong attachment preventing member 9 provided on the bottom surface of the main tank.

Because the ink supply port and the atmosphere communicating port are provided in the top surface of the main tank opposed to the bottom surface thereof and the later-described needles of the ink tank unit are inserted from above, it is possible to prevent ink from leaking from a coupled portion between the ink tank and the ink tank unit and to keep the ink tank unit from being stained with the ink even if improper coupling should be made when the ink tank is coupled to the ink tank unit.

The atmosphere communicating port 12 and the ink supply port 13 are closed by respective rubber plugs (not shown) fitted in the first and second caps in the form of projected portions so that the liquid inside the ink tank is prevented from leaking to the exterior inadvertently. Though not shown in FIG. 3, a tube 14 is provided in the housing 11 to extend from the ink supply port 13 to a position near the housing bottom (see FIG. 15). Even in a posture of the ink tank shown in FIG. 3, therefore, the liquid contained in the housing can be led out to the exterior through the tube 14 connected to the ink supply port upon suction from the exterior.

The first cap 2 and the second cap 3 are provided on the same surface opposed to the bottom surface of the main tank 1, and an end of that surface on the side of the first cap, i.e., an end of that surface on the front side in the direction, described later, in which the main tank is inserted, provides a lock release portion 4 which serves as a means for releasing a lock member on the main tank unit. Providing the lock member releasing means in a front portion of the ink tank makes it easily realizable to provide the lock member on the ink tank unit at a position to which the user's hand is hard to access, and to detect wrong attachment of the ink tank before release of the lock member in the later-described operation of inserting the ink tank.

Also, in this embodiment, the first and second caps each have a substantially cylindrical shape, and are arranged such that axes of the first and second caps are substantially aligned with each other and the first cap is positioned on the front side when viewed in the direction of insertion of the ink tank.

On the top surface opposed to the bottom surface of the main tank on the side of the second cap (i.e., on the rear side in the direction of insertion of the main tank), there are provided a slope which is extended upward to a level higher than the height of an end face of each cap opening, and a cap protecting rib 5 which serves to prevent the second cap 3 from being damaged upon a drop of the main tank.

Further, an end of the slope on the higher side (i.e., a rear end of the slope in the direction of insertion of the main tank) has a vertical surface portion 6 with which a lever of the main tank unit engages to fix the main tank. The vertical surface portion 6 is substantially perpendicular to the bottom surface of the main tank, and is parallel to the cylindrical portions of the first and second caps. The vertical surface portion 6 has a lower end extending downward to a position slightly lower in the vertical direction than the cylindrical portions of the first and second caps, and an upper end extending upward to a position higher than the openings of the first and second caps.

Moreover, the height of the second cap is selected to position under a line connecting the end face of the first cap, where the atmosphere communicating port is opened, and an upper end of the vertical surface portion 6. Accordingly, if the main tank should be dropped, the second cap does not directly strike against the ground and is prevented from being damaged upon a drop. Thus, in the ink tank of this embodiment, a coupled portion of the ink tank to the ink tank unit is protected to realize that the ink tank can be more positively coupled to a recording apparatus (described later) capable of mounting the ink tank on it. Note that the cap protecting rib 5 is not an essential component, but the provision of the rib enables the second cap to be protected more positively.

Below the vertical surface portion 6, holes penetrating the housing are formed to provide a grip portion 7 and a catch ring 8 both projecting from the vertical surface portion 6 so that users can easily handle the main tank when it is carried with them and removed from the main tank unit. In this embodiment, the grip portion 7 and the catch ring 8 are constructed of hollow portions which communicate with the interior of the housing and can contain an ink, allowing a liquid to be filled in those portions as well. With the presence of those portions, the amount by which ink can be contained in the main tank is increased.

The wrong attachment preventing member 9 provided on the bottom surface of the main tank comprises two lines of pawls 10. Cutting out an unnecessary portion of the pawls 10 causes the member 9 to prevent wrong attachment of the main tank unit. The wrong attachment preventing member 9 is provided at a front end of the bottom surface in the direction of insertion of the main tank.

Figure 4:
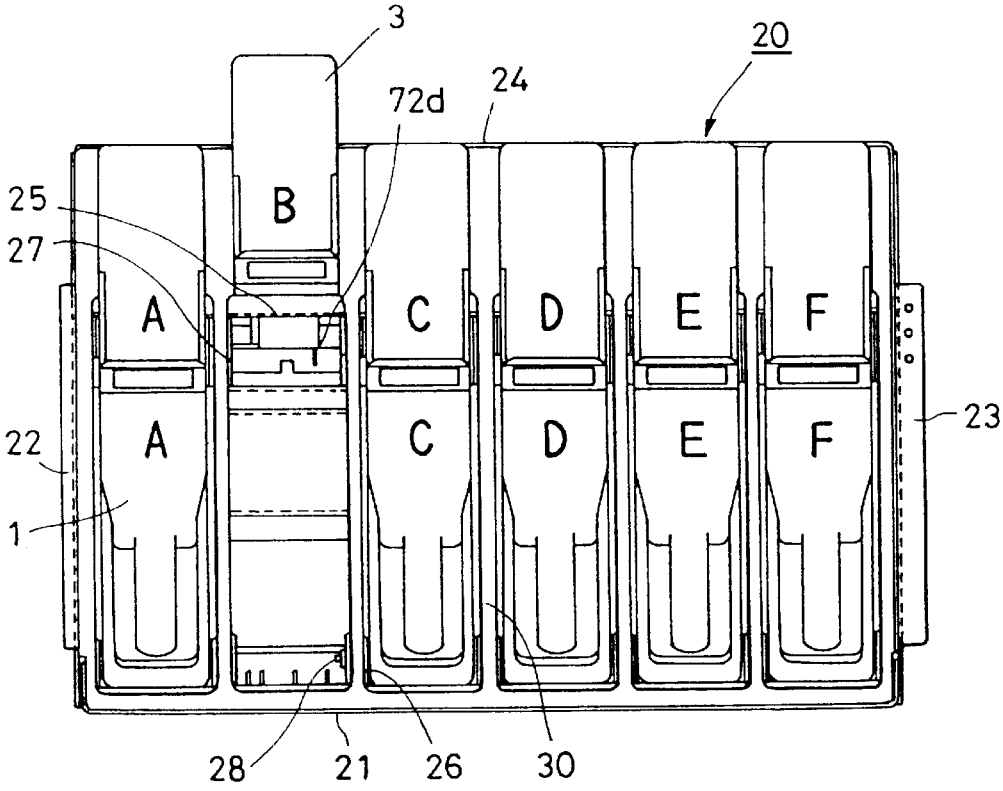
FIG. 4 is a front view of an ink tank unit according to the first embodiment of the present invention.
Figure 5:
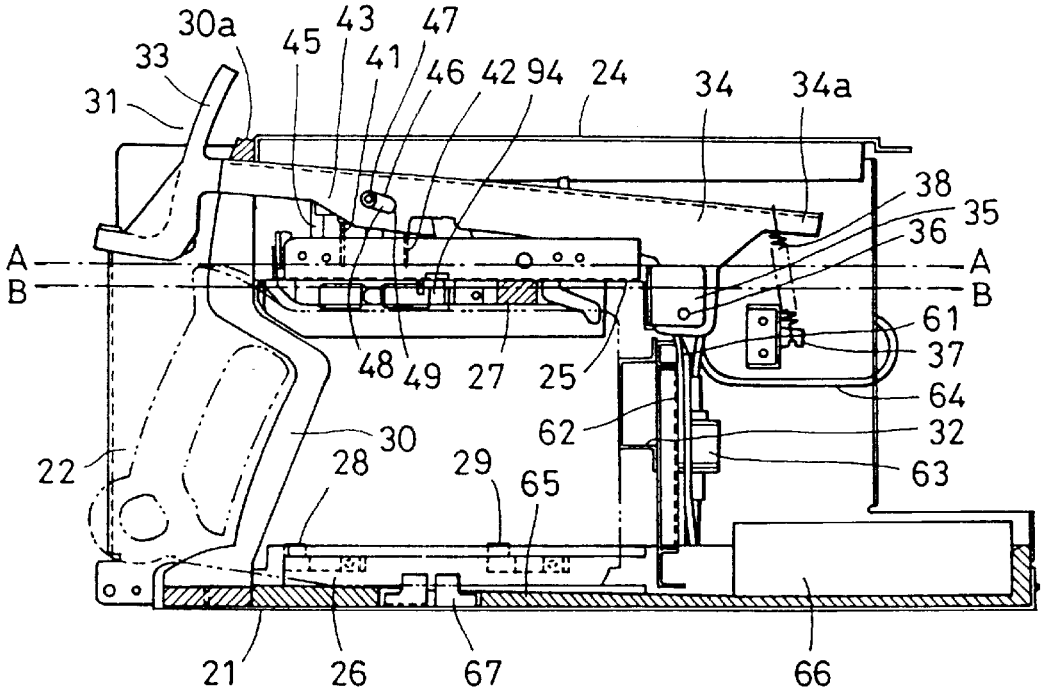
FIG. 5 is a side sectional explanatory view of the ink tank unit according to the first embodiment of the present invention.
Figure 6:
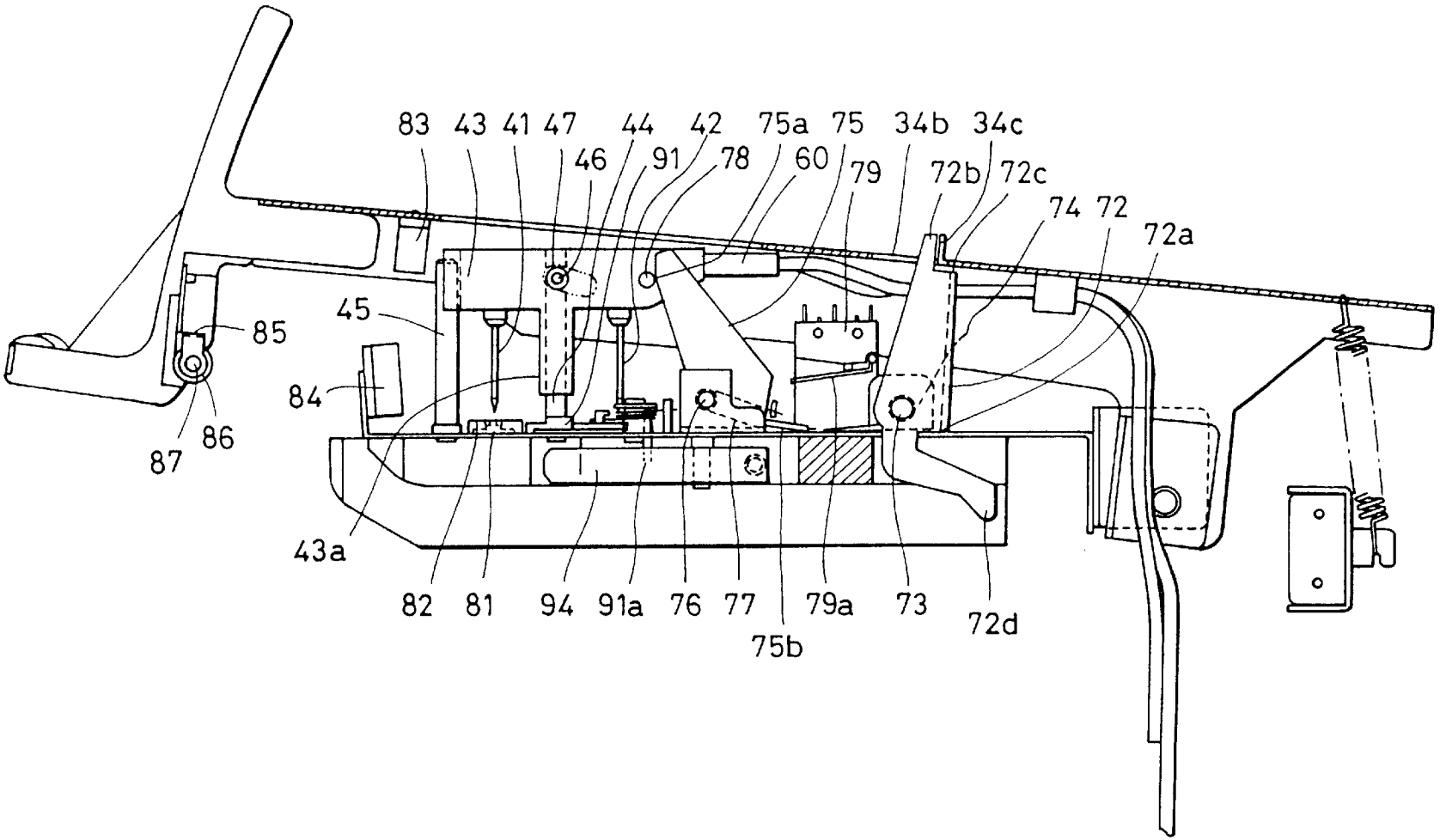
FIG. 6 is a side sectional view for explaining a principal part of FIG. 5.
Figure 7A:
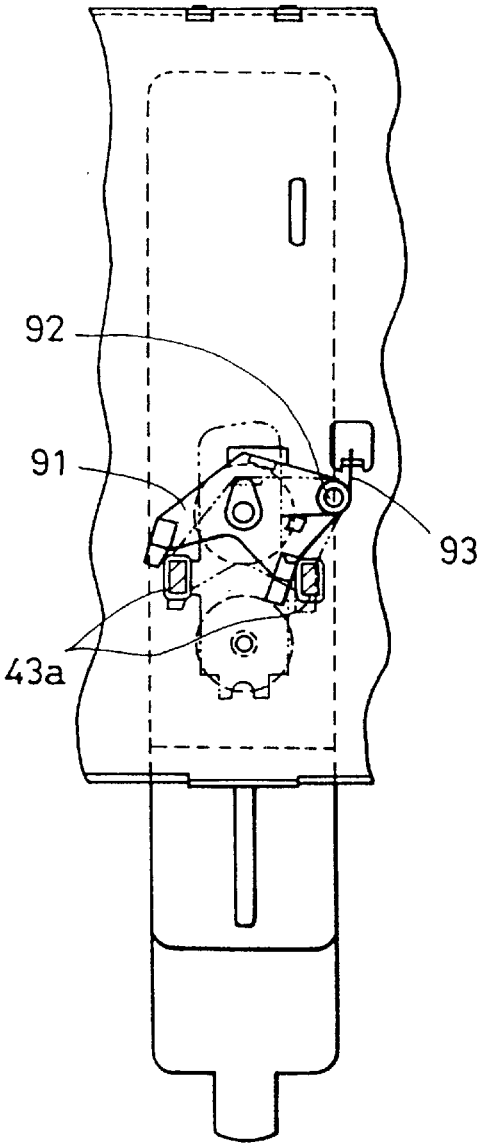
FIGS. 7A and 7B are sectional views taken along A—A and B—B, respectively, of the ink tank unit, shown in FIG. 4, according to the first embodiment of the present invention.
Figure 7B:
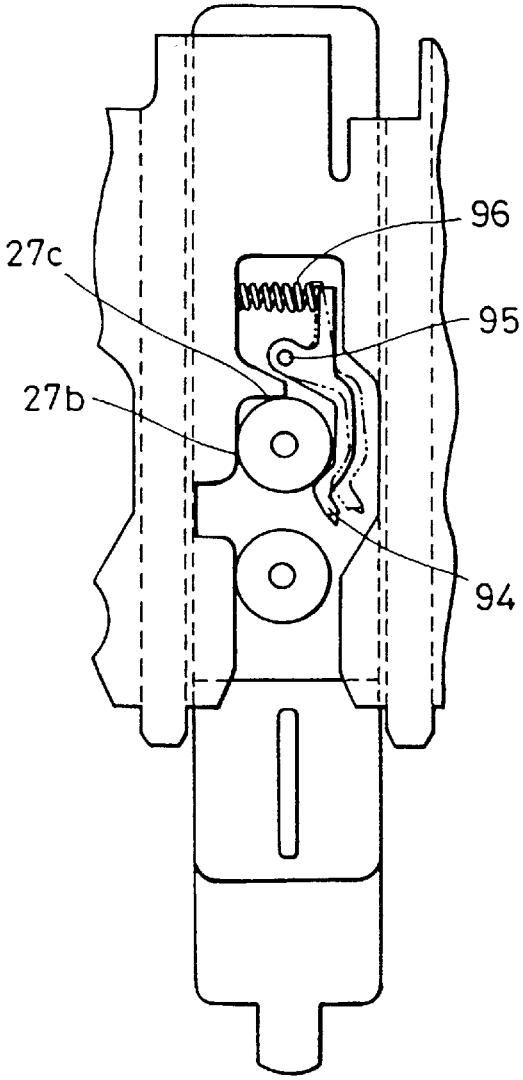

Next, the ink tank unit of the present invention, to which the ink tank shown in FIG. 3 is attached, will be described with reference to FIGS. 4 to 7. FIGS. 4 and 5 are explanatory views for explaining the entire ink tank unit of the present invention; FIG. 4 is a front view of a main tank unit 20 and FIG. 5 is a side sectional explanatory view thereof. FIG. 6 shows a principal part of the structure of the main tank unit shown in FIG. 5, and FIGS. 7A and 7B are sectional views taken along A—A and B—B in FIG. 5, respectively.

The ink tank unit (main tank unit) 20 of this embodiment receives one or a plurality of main tanks 1 (taking here as an example a unit receiving six tanks). The main tank unit 20 comprises a bottom plate 21 at the bottom of a housing, and a top plate 24 at the top of the housing. The bottom and top plates 21, 24 are connected at opposite ends by a left chassis 22 and a right chassis 23. Between the bottom and top plates 21, 24, a central plate 25 is provided to extend between the left chassis 22 and the right chassis 23 for enhancing rigidity of the housing in cooperation with a rear chassis 32 (described later), etc.

Numeral 26 denotes a lower guide for guiding a bottom portion of the main tank 1, and 27 denotes an upper guide for guiding a top portion of the main tank 1. Tank biasing springs 28, 29, which serve as second biasing means for biasing the main tank 1 to a second reference surface (described later), are provided on the right side of a recess of the lower guide 26 in which the main tank is received. The tank biasing springs 28, 29 press the main tank 1 to the left for properly positioning the bottom portion of the main tank 1. Adjacent portions for receiving the main tanks are partitioned by a front guide 30 so that users can recognize the receiving portion at a glance when the main tank 1 is to be inserted.

Numeral 31 denotes a tank lock lever on which symbols, characters, numerals or the like for identifying the color of ink are provided by means of engraving, printing or seal-pasting. In the illustrated embodiment, alphabets A to F are put on the tank lock levers by printing. Likewise, alphabets A to F are put on the corresponding main tanks 1, allowing users to recognize at a glance that the main tank of which color is to be inserted in which receiving portion. The tank lock lever 31 is raised to an upper position when the main tank 1 is not received, but after insertion of the main tank 1, it is depressed by users to lock the main tank to prevent the tank from being withdrawn inadvertently.

In this way, the main tank unit receives a plurality of main tanks of multiple colors. Thus, the ink tank of the present invention can increase space efficiency since the lengthwise direction of the ink tank is aligned with the direction in which the ink tank is inserted into the ink tank unit.

The tank lock lever 31 is mainly made up of a lever grip 33 operated by users, and a lever body 34. The tank lock lever 31 is supported in a rotatable manner about a lever shaft 36 provided on a lever support member 35. The lever support member 35 is fixed to the central plate 25. A tension spring 38 is disposed between an end 34a of the lever body 34 opposite to the lever grip 33 and a spring hook 37 provided between the left and right chassis 22, 23. Accordingly, the tank lock lever 31 is always urged in the clockwise direction about the lever shaft 36 and is held in a state abutting an abutment portion 30*a* of the front guide.

Numerals 41, 42 each denote a hollow needle having a sharpened slender tip. The needle 41 is an ink supply needle provided to suck up the ink in the main tank 1, and the needle 42 is an atmosphere communicating needle provided to communicate the interior of the main tank 1 to the atmosphere. The needles 41, 42 are held by a needle holder 43 which is movable along columnar guide shafts 44, 45 fixedly provided on the central plate 25.

A pair of pins 46 and rollers 47 rotatably fitted over the pins 46 are provided on both sides of the needle holder 43. The rollers 47 are engaged in bearing members 49 provided on both sides of the lever body 34. This construction enables the needle holder 43 and the needles 41, 42 to be moved downward when the tank lock lever 31 is depressed.

The needles 41, 42 are bent into an L-shape in the needle holder 43 and are joined with tubes 61, 62 by rubber-made needle joints 60, respectively. When the ink supply path shown in FIG. 2 is employed, the tube 61 is connected to the sub-tank through a check valve 63 for preventing a reverse flow of ink from the sub-tank side and a tube 64. As described above in connection with FIG. 2, an ink feed pump is provided midway the tube 64. The tube 62 is extended to the back of the rear chassis 32 and is opened at its end to the atmosphere. Accordingly, when the pump is operated, the check valve 63 is opened to supply the ink in the main tank 1 to the sub-tank, while air is introduced to the main tank 1 through the tube 62.

An inclined groove 65 is formed at the center of the main tank receiving portion of the lower guide 26 to extend from an entrance for the main tank to the inner side, and an ink absorber 66 is disposed on the innermost side to extend in a continuous relation to the inclined groove 65 in the direction of insertion of the main tank 1. The ink absorber 66 is capable of absorbing an amount of ink corresponding to one main tank so that even if ink should leak upon breakage of the main tank 1, the ink is prevented from spilling out of the main tank unit. The inclined groove 65 is inclined at an angle 1.5° in this embodiment, thus allowing the leaked ink to smoothly flow to the ink absorber 66.

Numeral 67 denotes an identifying/wrong-attachment preventing member. When a main tank containing ink of other color than to be received there is inserted, an unremoved portion of the pawls 10, shown in FIG. 3B, strikes against the identifying/wrong-attachment preventing member 67, and insertion of the main tank is blocked halfway. Hence users can notice that the main tank has been falsely inserted.

Numeral 72 denotes a lever lock member which is supported to be able to swing about a support shaft 73 and is always biased in the clockwise direction by a torsion spring 74. The lever lock member 72 is held in a state where its abutment portion 72*a* abuts the central plate 25 (see FIG. 6). An upper end portion 72*b* of the lever lock member 72 penetrates an opening 34*b* formed in the lever body 34. Accordingly, if users try to depress the tank lock lever 31 in such a state, a bent portion 34*c* of the lever body 34 strikes against a shoulder portion 72*c* of the lever lock member 72, whereby the tank lock lever 31 is kept from moving further downward.

Numeral 75 denotes a detecting plate which is supported to be able to rotate about a support shaft 76 and is always biased in the counterclockwise direction by a torsion spring 77. An abutment portion 75*a* of the detecting plate 75 abuts a holder pin 78 fixedly provided on the needle holder 43. When the needle holder 43 is moved downward to a predetermined lowermost position and the detecting plate 75 is rotated in the counterclockwise direction correspondingly, a projection 75*b* of the detecting plate 75 presses a detecting portion 79*a* of a microswitch 79. It is thus detected that the needles 41, 42 have moved to predetermined positions.

Numeral 81 denotes an absorber for wiping off the ink adhering to the needle 41 when the needle 41 is removed out of the main tank 1, the absorber 81 being held in place by an absorber retainer 82. Numeral 83 denotes a convex member which is provided on the lever body 34 and engages a concave member 84 fixed to the central plate 25. The convex member 83 and the concave member 84 are each made of materials having resiliency such as polyacetal and polypropyrene. When the tank lock lever 31 is depressed, the convex and concave members 83, 84 engage with each other to hold the tank lock lever 31 in the depressed position. When the tank lock lever 31 is lifted by a force larger than a predetermined magnitude, the convex and concave members 83, 84 are disengaged from each other. Further, the lever body 34 includes a leaf spring 85 as a means for biasing the tank, a roller 86, and a support shaft 87 for supporting the roller 86 rotatably. The leaf spring 85 has one end fixed to the lever grip 33, and the other end provided with the roller 86 as an idler and the support shaft 87.

A stopper 91 is rotatable about a pivot shaft 92 fixedly provided to extend upward from the central plate 25, and is always biased in the counterclockwise direction by a torsion spring 93 (see FIG. 7A). When the main tank 1 not received, the stopper 91 is positioned right below leg portions 43*a* of the needle holder 43, and therefore the needle holder 43 is kept from moving further downward.

Numeral 94 denotes a click member which is rotatable about a pivot shaft 95 fixedly provided to extend downward from the central plate 25, and is always biased in the clockwise direction by a compression spring 96 (see FIG. 7B).

In addition, numeral 27*c* denotes an abutment surface as a first reference surface, and 27*b* denotes an abutment surface as a second reference surface, the first and second reference surfaces being both provided on the upper guide 27. The first and second reference surfaces are perpendicular to each other, and the first reference surface is perpendicular to the direction of insertion of the main tank. Thus, the second reference surface is parallel to both the direction of insertion of the main tank and the direction of movement of the needle holder 43 which serves as a means for moving the needles. The click member 94 presses the cap in the form of a projected portion of the main tank to abut the abutment surfaces 27*b* and 27*c*.

Next, the operation of attaching the ink tank shown in FIG. 3 to the ink tank unit shown in FIG. 4 will be described with reference to FIGS. 8 to 15.

FIGS. 8 to 15 are explanatory views for explaining the method of coupling the ink tank and the ink tank unit according to the first embodiment of the present invention step by step.

Figure 8:
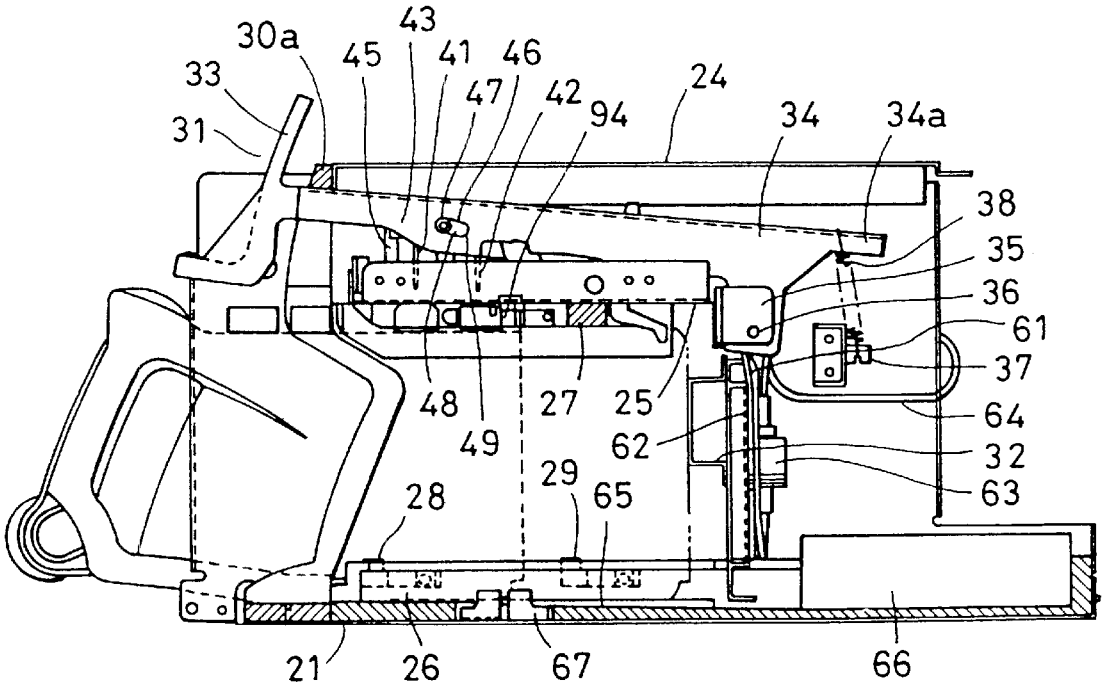
FIG. 8 is a side sectional view showing the ink tank and the ink tank unit according to the first embodiment of the present invention at the time when insertion of the ink tank is started.
Figure 9A:
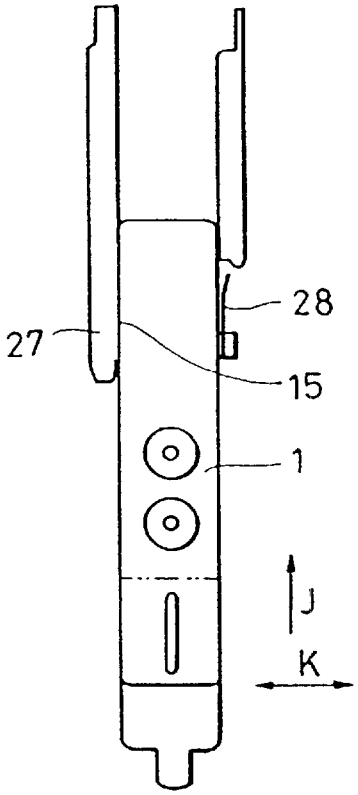
FIGS. 9A and 9B are explanatory views showing the ink tank and the ink tank unit according to the first embodiment of the present invention at the time when insertion of the ink tank is started.
Figure 9B:
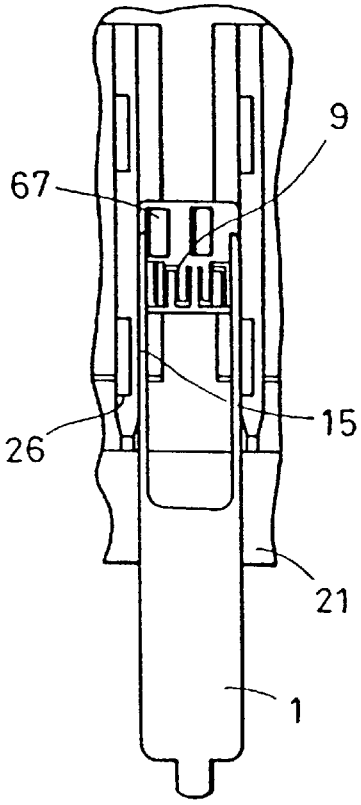

First, as shown in FIGS. 8, 9A and 9B, the main tank 1 is inserted into the main tank unit 20 in a direction J, shown in FIG. 9A, while it is guided by the upper guide 27 and the lower guide 26. FIG. 8 is a side sectional view showing the ink tank and the ink tank unit at the time when insertion of the ink tank is started, and FIGS. 9A and 9B are sectional views of a principal part sectioned along planes perpendicular to the drawing sheet of the FIG. 8 and viewed from the top and the bottom, respectively.

The main tank 1 inserted in the direction J is pressed by the tank biasing springs 28, 29 provided on the lower guide 26 against reference surfaces 15 formed in the lower guide 26 and the upper guide 27, whereby the main tank 1 is positioned relative to the main tank unit 20 in a direction K (i.e., a direction perpendicular to the direction of insertion of the main tank in FIG. 9A). In other words, since the ink tank is pressed against the reference surfaces, the ink tank is avoided from wobbling in the direction K during the operation of attaching and detaching it and after the attachment.

With further insertion of the main tank 1 into the main tank unit 20, as shown in FIG. 9B, the wrong attachment preventing member (pawls) provided at the bottom of the main tank 1 reaches the position of the identifying/wrong-attachment preventing member 67 provided on the bottom plate of the main tank unit 20.

Here, an ink tank having the wrong attachment preventing member, in which the pawls corresponding to ribs of the identifying/wrong-attachment preventing member 67 are cut out, can pass the position of the member 67, but an ink tank having the wrong attachment preventing member, in which the corresponding pawls are not cut out, cannot be inserted further beyond the position of the member 67. In this embodiment, ink tanks are allowed to be attached in different positions corresponding to ink colors. Therefore, even if users should miss an identification label, an ink tank containing ink of other color than the matched one can be prevented from being inserted falsely.

In the ink tank unit of the present invention, the ink tank reaches the position of the identifying/wrong-attachment preventing member 67 after being pressed against the reference surfaces. Accordingly, when the ink tank is inserted into the corresponding position of the ink tank unit through proper combination between the wrong attachment preventing member (pawls) on the ink tank side and the identifying/wrong-attachment preventing member 67 on the ink tank unit side, the identifying/wrong-attachment preventing member 67 is prevented from malfunctioning due to a shift of the ink tank in the direction K shown in FIG. 9A.

Figure 10:
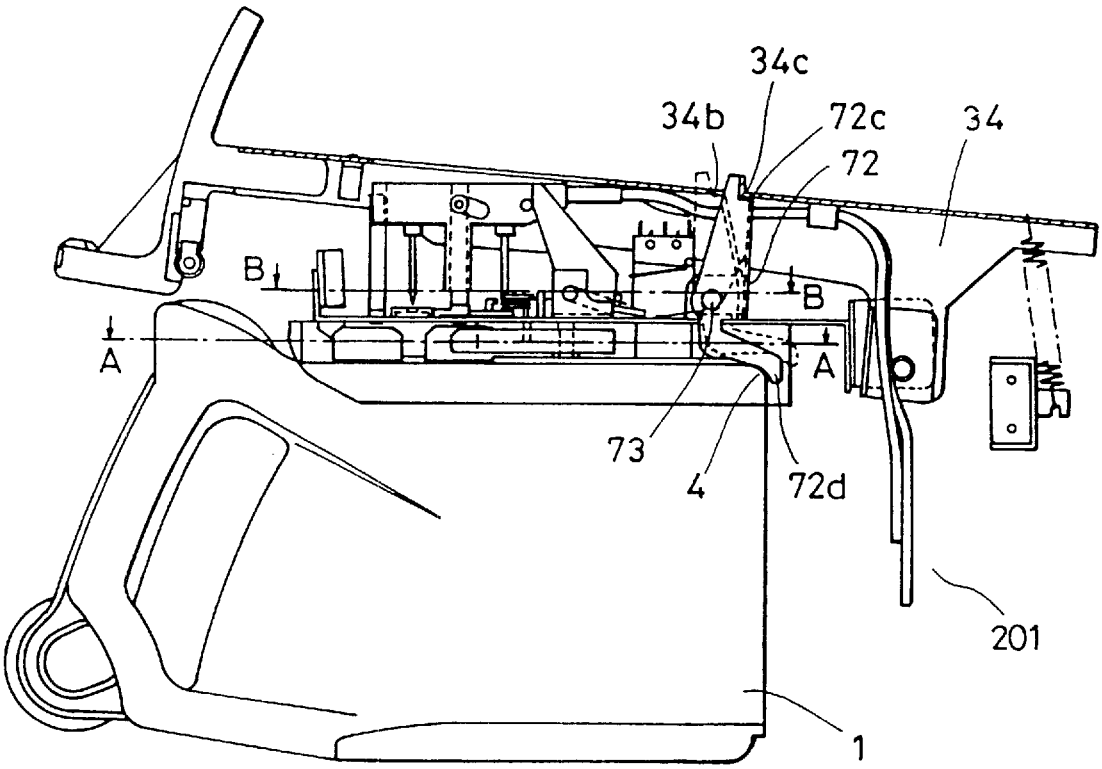
FIG. 10 is a side sectional view showing the ink tank and the ink tank unit according to the first embodiment of the present invention while the ink tank is being inserted into the ink tank unit.
Figure 11A:
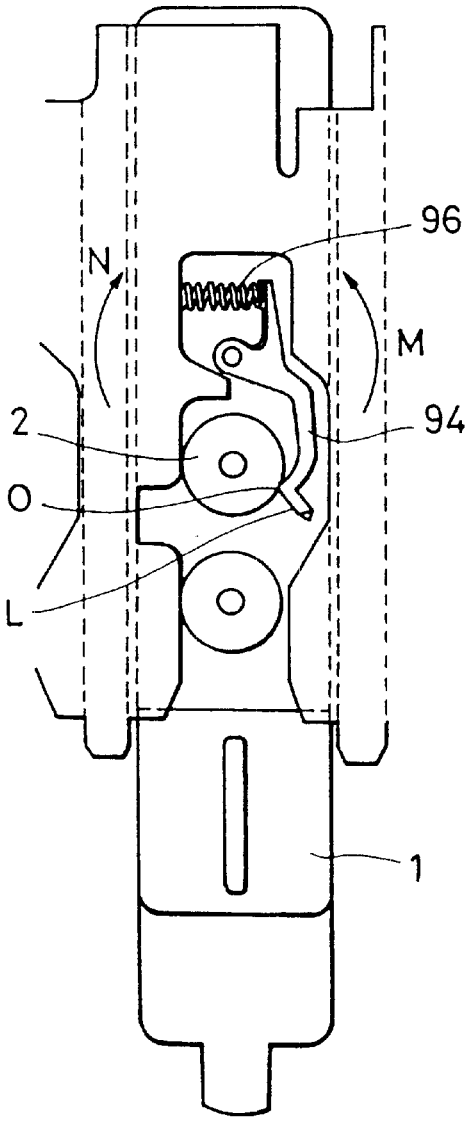
FIGS. 11A and 11B are explanatory views showing the ink tank and the ink tank unit according to the first embodiment of the present invention while the ink tank is being inserted into the ink tank unit.

With still further insertion of the main tank 1 into the main tank unit 20, as shown in FIG. 10, the lock release portion 4 of the main tank 1 strikes against the lever lock member 72 provided on the main tank unit 20. FIGS. 10 and 11 show the ink tank and the ink tank unit at the time when the lock release portion 4 strikes against the lever lock member 72 to unlock the lever, and FIGS. 12 and 13 show a condition where the insertion of the ink tank is completed. FIGS. 10 and 12 are side sectional views of the ink tank and the ink tank unit. In FIGS. 11 and 13, A and B are sectional views taken along A—A and B—B in FIG. 10, respectively.

When the main tank 1 is further inserted to the innermost side after the lock release portion 4 has struck against the lever lock member 72, the lock release portion 4 pushes the lever lock member 72, whereupon the lever lock member 72 is rotated counterclockwise about the support shaft 73 to a position indicated by dotted lines in FIG. 10. With this rotation, the shoulder portion (lock portion) 72*c* of the lever lock member 72 is disengaged from the bent portion (receiving portion) 34*c* provided on the lever body 34, and then moves to a position just corresponding to the opening 34*b*. As a result, the lever body 34 is released from the condition locked by the lever lock member 72.

Thus, since a lock lever as a first needle movement preventing means is rotated to an unlock position upon the insertion of the tank, users are required to perform just the operation of inserting the tank, while the lever body is prevented from being erroneously unlocked when any other member than the tank is inserted. Hence, even if users inadvertently put the hands into the ink tank unit the hands are kept from being injured by the needles.

Also, since the lock lever is released by the front end of the tank, it is possible to not only provide the lock lever in a position to which the user's hand is hard to access, and but also detect wrong attachment of the tank for prevention of the wrong attachment before release of the lock lever. In this embodiment, the lateral surface of the tank is pressed to abut the reference surface, and the lever is inhibited from being moved downward until whether the tank is inserted properly or falsely has been confirmed by the wrong attachment preventing member. Therefore, the first needle movement preventing means unlocks the lever after positive detection as to whether the tank is inserted properly or falsely, and a different type of tank from the allowable type is prevented from being attached falsely.

With still further insertion of the main tank 1 into the main tank unit 20, as shown in FIG. 1 1A, the first cap 2 of the main tank 1 strikes against a distal end portion (L) of the click member 94 to rotate the click member 94 counterclockwise in a direction M. As a result, the first cap 2 abuts a projection (O) of the click member 94. At this time, the compression spring 96 is compressed to generate a force tending to rotate the click member 94 in a direction N (clockwise), and the click member 94 provides resistance against the insertion of the main tank. Because of the click member 94 being substantially arc-shaped, however, when the main tank is further inserted and the abutting position between the click member 94 and the first cap 2 is shifted to a rear portion of the first cap in the direction of insertion of the main tank, the click member 94 is allowed to rotate clockwise from a certain position, and provides a force tending to promote the insertion of the main tank. Finally, the click member 94 presses the first cap 2 against both the lateral abutment surface 27*b* and the perpendicular abutment surface 27*c* of the upper guide 27, thereby positioning the upper portion of the main tank (see FIG. 13A). By positioning the coupled portion between the main tank and the main tank unit with the aid of the cap in such a manner, positioning accuracy of a large-sized container can be improved. Also, since users can easily detect the above-mentioned change of the force generated by the click member 94 with a click feel, they can confirm that the main tank has been positively inserted.

Figure 11B:
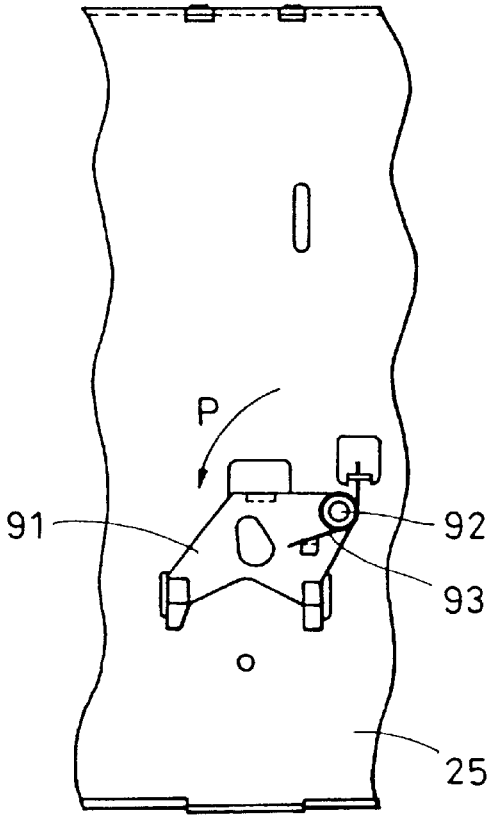
Figure 12:
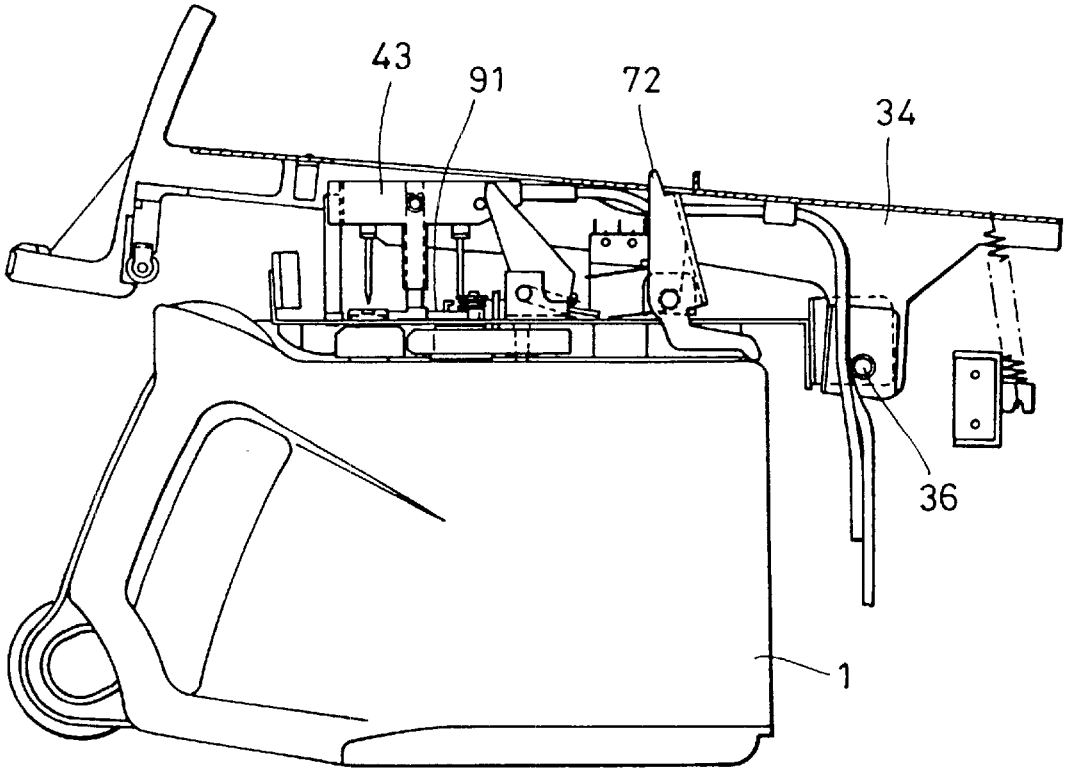
FIG. 12 is an explanatory view showing the ink tank and the ink tank unit according to the first embodiment of the present invention at the time when the ink tank has been inserted into the ink tank unit.

Before coming into a condition where the insertion of the main tank is promoted by the rotation of the click member 94, as shown in FIG. 11B, the stopper 91 supported to be rotatable about the pivot shaft 92, which is fixedly provided on the central plate 25, is biased in a direction P by the torsion spring 93. Accordingly, even if the lever lock member is rotated to the unlock position, the needle holder 43 cannot be moved further downward in such a condition, as described above in connection with FIG. 7, thus protecting the needles.

Figure 13A:
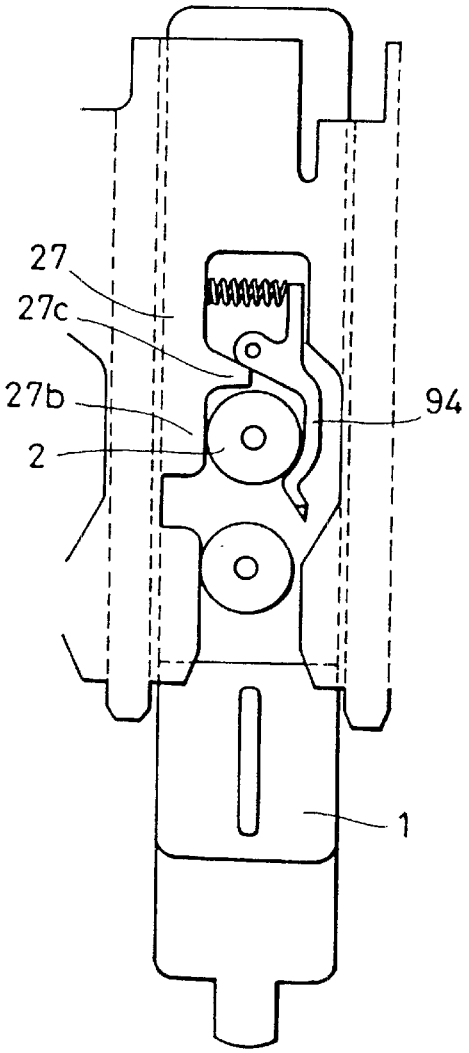
FIGS. 13A and 13B are explanatory views showing the ink tank and the ink tank unit according to the first embodiment of the present invention when the ink tank has been inserted into the ink tank unit.
Figure 13B:
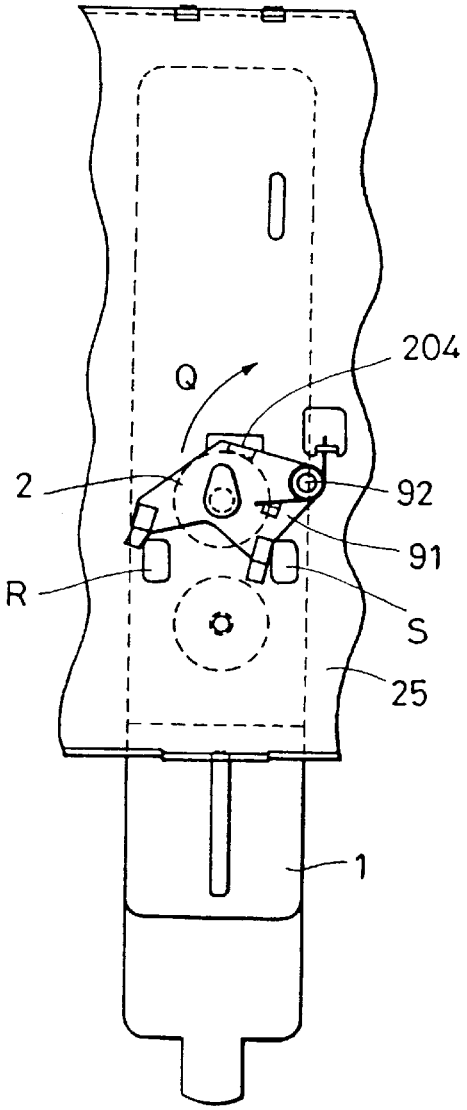

When the first cap in the form of a first projected portion of the main tank 1 is inserted toward the innermost side of the main tank unit 20 with the aid of the click member 94 as a means for pressing the first cap against the reference surfaces (namely, the main tank comes into the condition where the insertion of the main tank is promoted by the rotation of the click member 94), the first cap of the main tank 1 pushes a tongue portion 204 of the stopper 91 as shown in FIG. 13B, whereupon the stopper 91 is rotated about the pivot shaft 92 in a direction Q shown in FIG. 13B.

As a result, the stopper 91 is shifted from portions indicated by R and S. The central plate 25 has holes formed in positions corresponding to the portions R and S. After the shift of the stopper 91, therefore, nothing blocks the leg portions 43*a* of the needle holder 43 from moving downward. Thus, upon the rotation of the stopper 91, the needle holder 43 is unlocked and allowed to pass the holes in the central plate 25 formed corresponding to the portions R and S.

Consequently, since the clicking also implies that the stopper 91 as a second needle movement preventing means has been rotated to an unlock position, users can perform the later-described operation of connecting the needles without anxiety after sensing a click feel. To make the click feel provided by the click member also imply the rotation of the second needle movement preventing means to the unlock position, it is desired that the operation of unlocking the needle holder be not effected before coming into the condition where the insertion of the main tank is promoted by the rotation of the click member, as with this embodiment.

FIG. 12 is a side view showing a condition where the operation of inserting the main tank 1 into the main tank unit 20 is completed. In such a condition, the insertion of the main tank 1 is completed and two locks for the lever, i.e., lock of the needle holder 43 by the stopper 91 and lock of the rotation of the lever body 34 about the lever shaft 36 by the lever lock member 72, are released.

In this embodiment, the needle holder is locked by two members, i.e., the lever lock member 72 as the first needle movement preventing means and the stopper 91 as the second needle movement preventing means. Accordingly, even if users should erroneously put their hands into the ink tank unit and try to depress the lever by rotating the lever lock member to the unlock position, the users are protected from being injured by the needles provided on the needle holder. At the same time, the needles are protected even if any foreign matter is inserted into the ink tank unit. In the case of providing only one needle movement preventing means, it is desired from the point of realizing positive insertion of the needles that the needle movement preventing means is provided near the position at which the needles are inserted, as with the stopper 91 in this embodiment. Further, by providing two needle movement preventing means like this embodiment, one of the two preventing means is not required to be provided near the position at which the needles are inserted, and therefore the one preventing means can be constructed to have increased strength.

Further, where an ink tank having a plurality of projections arranged in the direction of insertion thereof is coupled to the ink tank unit as with this embodiment, more positive coupling between the ink tank and the ink tank unit can be realized in an ink jet recording apparatus, which employs inks of multiple colors, without requiring a waste space while the ink tank is prevented from wobbling in the direction of insertion thereof, by pressing the projected portion on the front side in the direction of insertion of the ink tank to abut a first reference surface perpendicular to the direction of insertion of the ink tank and pressing the other one or more projected portions to abut a second reference surface perpendicular to the first reference surface. In the case of an ink tank having three or more projected portions, the above-stated advantages can be provided by pressing the projected portions to abut the respective reference surfaces in a similar manner. In this embodiment, particularly, since the projected portions taking part in the coupling between the ink tank and the ink tank unit are manufactured as caps separately from the housing which constitutes the ink containing portion, reliability of coupling accuracy can be further improved. The projected portions manufactured separately from the housing can be united with the housing in the form of caps as with this embodiment, or joined by welding, bonding or the like.

Moreover, since first and second pressing means are constituted by the click member for pressing the projected portion to abut the first reference surface, users can easily sense with a positive click feel that the ink tank has been positioned.

By depressing the lever after the ink tank has been positioned with the aid of the cap as described above, the ink tank is fixedly held and connected to an ink supply path (not shown) simultaneously.

Figure 14:
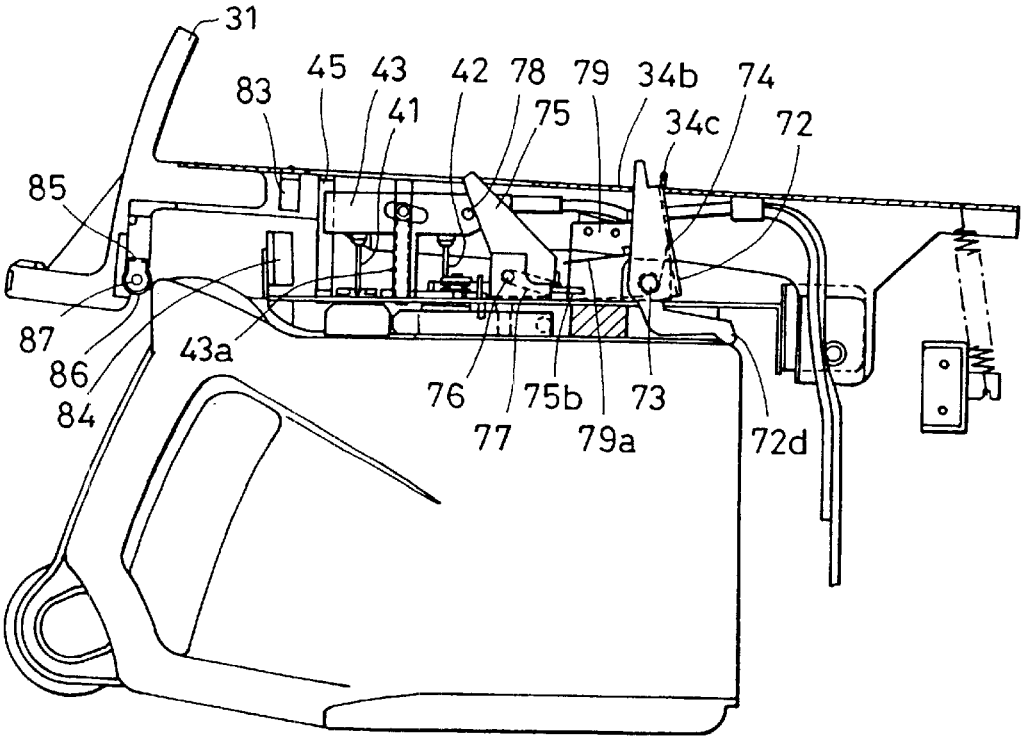
FIG. 14 is a side sectional view of the ink tank and the ink tank unit according to the first embodiment of the present invention, showing the operation of depressing a lever.
Figure 15:
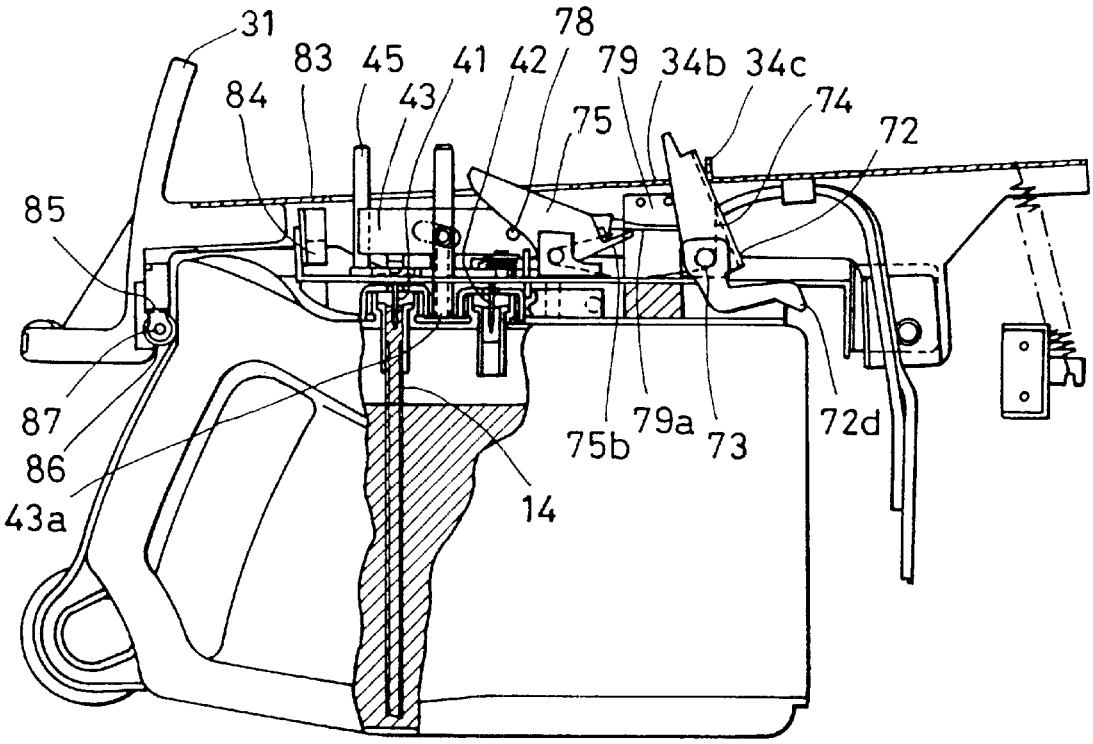
FIG. 15 is a side sectional view of the ink tank and the ink tank unit according to the first embodiment of the present invention, showing the operation of depressing the lever.

FIGS. 14 and 15 are side sectional views of the ink tank and the ink tank unit, showing the operation of depressing the lever in a time sequential manner.

When the tank lock lever 31 is depressed, the needle holder 43 is descended along the guide shafts 44, 45 and the needles 41, 42 are also descended with the needle holder 43. At this time, the lever lock member 72 is rotated counterclockwise by the front upper portion of the main tank 1 about the support shaft 73, and the shoulder portion 72*c* is positioned just corresponding to the opening 34*b*. Therefore, the lever lock member 72 does not interfere with the depression of the tank lock lever 31. When the tank lock lever 31 is depressed more downward from the position shown in FIG. 14, the bent portion 34*c* pushes the lever lock member 72 to further rotate the lever lock member 72 counterclockwise.

In the position shown in FIG. 14, the roller 86 contacts the upper end of the vertical surface portion 6 of the main tank 1. Even if the main tank 1 is not fully inserted and is slightly displaced toward the user (for example, it locates in a position corresponding to halfway the tank holding operation by the click member), the roller 86 as an urging means pushes the main tank 1 to the inner side while rotating through the leaf spring 85. Accordingly, the needles 41, 42 are prevented from being inserted into the caps in a condition where the main tank does not reach the predetermined position. To correct the position of the main tank 1 before the needles 41, 42 come into contact with the first and second caps 2, 3, the roller 86 is disposed in a lower end portion of the tank lock lever 31 and the upper end of the vertical surface portion 6 is located above the columnar portions of the two caps.

With further depression of the tank lock lever 31 from the position shown in FIG. 14, the needles 41, 42 are inserted and penetrated through substantially the centers of rubber plugs (not shown) fitted to the ink supply port and the atmosphere communicating port of the main tank 1, respectively. FIG. 15 shows a state where the tank lock lever 31 is fully depressed. When the tank lock lever 31 is fully depressed, the convex member 83 engages the concave member 84, and the tank lock lever 31 is held in that position against the biasing force of the tension spring 38. At the same time, the detecting plate 75 in contact with the holder pin 78 on the needle holder 43 is rotated counterclockwise about the support shaft 76 as the needle holder 43 descends. When the needle holder 43 reaches its lowermost position, i.e., when the needles 41, 42 reach their lowermost positions, the projection 75*b* of the detecting plate 75 presses the detecting portion 79*a* of the microswitch 79. The microswitch 79 is connected to a pump driving circuit, for example. Thus, only when the microswitch 79 is depressed, i.e., only when the needles 41, 42 are descended to the predetermined positions, a pump can be operated to suck ink from the main tank.

At this time, the roller 86 of the tank lock lever is fixedly located at the lower end of the vertical surface portion 6, i.e., at a position even with or slightly lower than the positions of columnar surfaces of the two caps in the direction of gravity, as shown in FIG. 15. In the case of urging the tank in the direction of insertion thereof like this embodiment, there is a fear that the urging force may produce a moment with the columnar surface of the cap, with which the tank is positioned, serving as a fulcrum. The moment produced in the counterclockwise direction in the sectional views of FIGS. 14 and 15 can be borne by the bottom plate of the tank holder, while the moment produced in the clockwise direction may cause a shift of the tank because there is nothing to bear the moment. In this embodiment, however, an upward moment is not produced with the above-described construction and the tank is surely kept from shifting from the proper position.

Although the above-mentioned detecting mechanism using the microswitch 79 may be provided for each main tank 1, it is also possible to arrange the mechanism such that detection is effected only when six tank lock levers 31 are all descended. For example, six detecting plates 75, each of which is the same as that shown in FIG. 14, are interconnected at their parts into an integral member. Then, one projection 75*b* is provided for the six integral detecting plates 75, and one microswitch 79 is provided corresponding to the one projection 75*b*.

If any one of the tank lock levers 31 remains at an upper position, the detecting plates 75 are not rotated and the microswitch 79 is not depressed. Only when the final tank lock lever 31 is descended to the lowermost position, the projection 75*b* presses the microswitch 79, whereby it is detected that all the tank lock levers 31 have been moved down to the lowermost positions. With the above construction, the number of parts can be reduced remarkably, thus resulting in cutdown of a cost and more effective use of a space.

Additionally, the above-described construction may be modified such that the main tank 1 is directly urged by the leaf spring 85 by omitting the roller 86 and the support shaft 87 of the tank lock lever 31.

Second Embodiment

In the above first embodiment, the ink tank is positioned by pressing the first cap in the form of the first projected portion of the ink tank to abut the lateral abutment surface and the perpendicular abutment surface with the aid of the click member. However, a manner of positioning the ink tank with a cap in the form of a projected portion is not limited to it.

Figure 16:
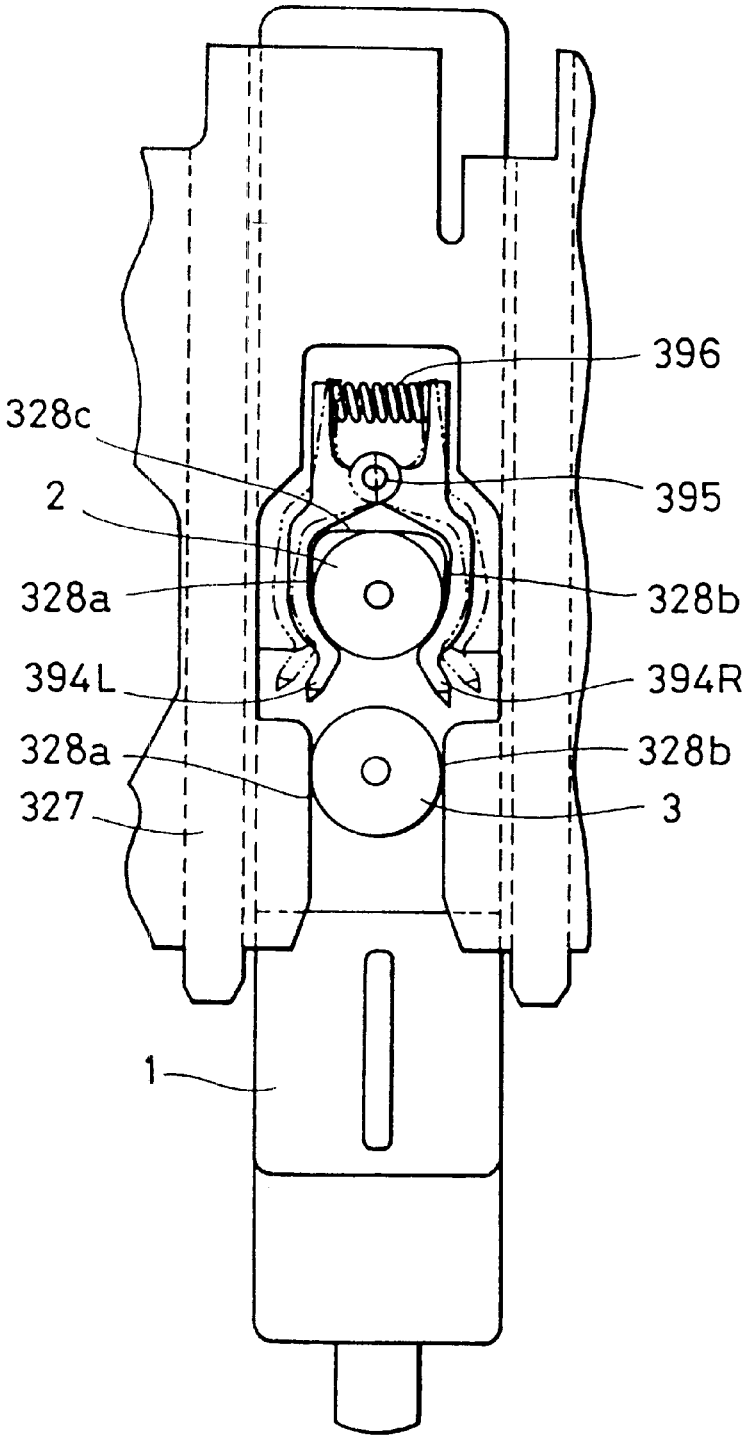
FIG. 16 is a sectional view of a principal part of an ink tank unit according to a second embodiment of the present invention.
Figure 17:
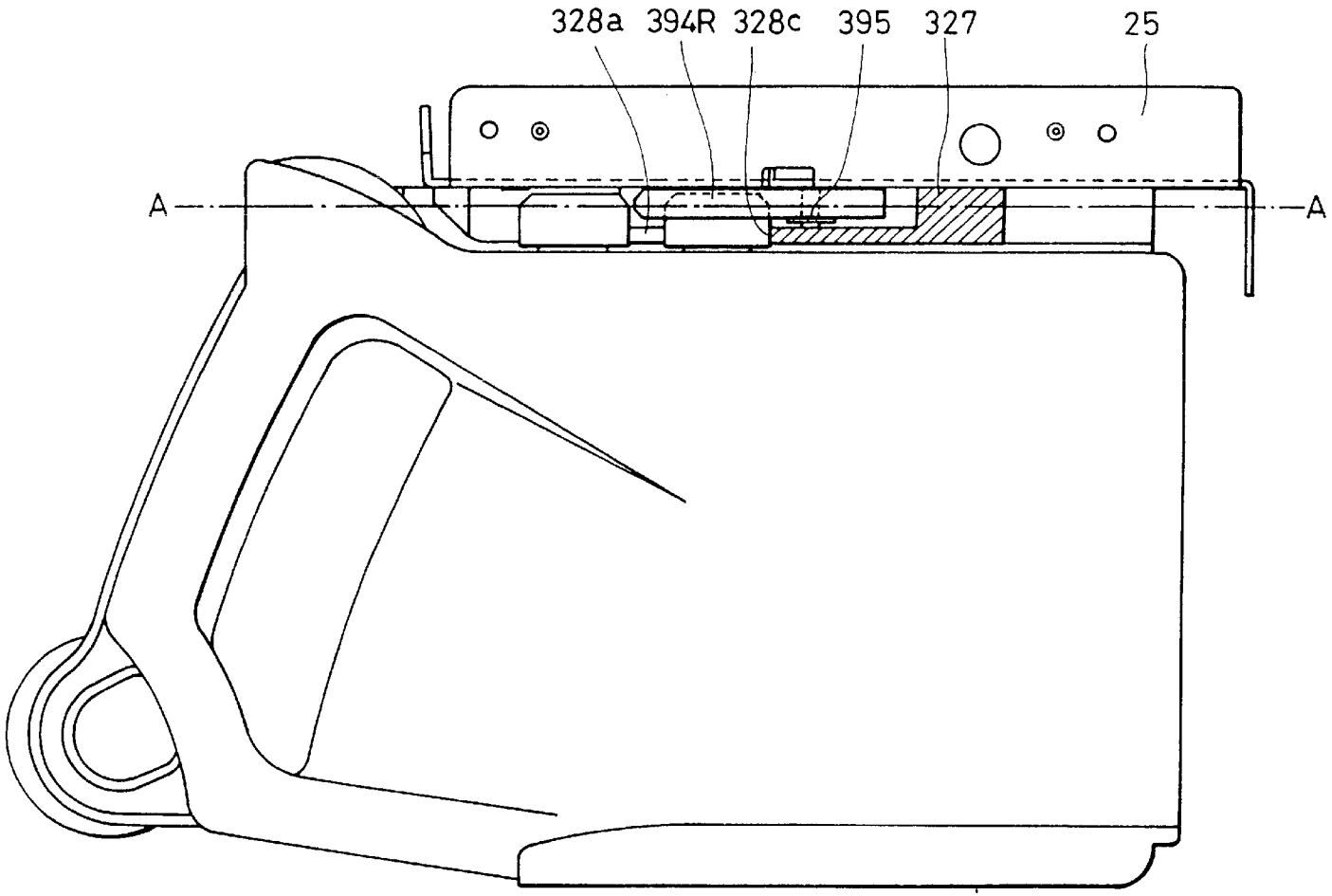
FIG. 17 is a side sectional view of the principal part of the ink tank unit, shown in FIG. 16, according to the second embodiment of the present invention.

FIG. 16 is a sectional view of a principal part of an ink tank unit according to the second embodiment of the present invention, and FIG. 17 is a side sectional view of the principal part of the ink tank unit shown in FIG. 16. FIG. 16 corresponds to a sectional view taken along A—A in FIG. 17.

This second embodiment differs from the above first embodiment in shapes of the upper guide and the click member.

A click member 394 in this embodiment comprises a right click member 394R and a left click member 394L which are substantially symmetrical about the center line. The right click member 394R and the left click member 394L are both rotatable about a pivot shaft 395 fixedly provided on a central plate 25. A compression spring 396 always biases the right click member 394R clockwise and the left click member 394L counterclockwise. An upper guide 327 includes a U-shaped cap guide portion 328 comprising lateral abutment surfaces 328*a*, 328*b* and a perpendicular abutment surface 328*c*. The cap guide portion 328 serving as a U-shaped guide is opened in the direction of insertion of the tank. The cap guide portion 328 has a width enough to allow insertion of the caps of the main tank, but adapted to essentially prevent the caps from wobbling. Therefore, the main tank is positioned laterally upon the first and second caps being both inserted in the cap guide portion 328. The longitudinal position of the main tank is determined upon the click member 394 catching the first cap 2 and then the first cap 2 abutting the perpendicular abutment surface 328*c*.

As shown in FIG. 17, the U-shaped cap guide portion 328 of the upper guide 327 is disposed under the click member 394. Of course, the click member 394 and the U-shaped cap guide portion 328 may be disposed in a vertically reversed relation to the illustrated one.

Also in this embodiment, the needles are inserted substantially perpendicularly to the direction of insertion of the tank, and after inserting the tank, the tank is abutted with the reference surfaces perpendicular to the direction of insertion of the needles. This produces no force component in a direction opposing to the direction of insertion of the tank in which the tank is more likely to shift upon the insertion of the needles while the tank is positioned. Accordingly, the ink tank is prevented from shifting upon the insertion of the needles, and reliability of coupling between the ink tank and the ink tank unit can be further improved.

In the above first embodiment, accurate positioning of the ink tank is realized by positioning the caps in the form of projected portions of the ink tank with respect to the two orthogonal reference surfaces. In this second embodiment, since the caps of the ink tank are guided to follow the U-shaped cap guide portion, the ink tank can be positioned, particularly in the lateral direction, with a simpler construction than in the above first embodiment. Further, since the click member is made up of two parts which are symmetrical about the center line, users can be given with a more positive click feel.

Third Embodiment

In the above first and second embodiments, the click member is constructed to press the first projected portion after the ink tank has been inserted, but it may be constructed to press the second projected portion.

Figure 18B:
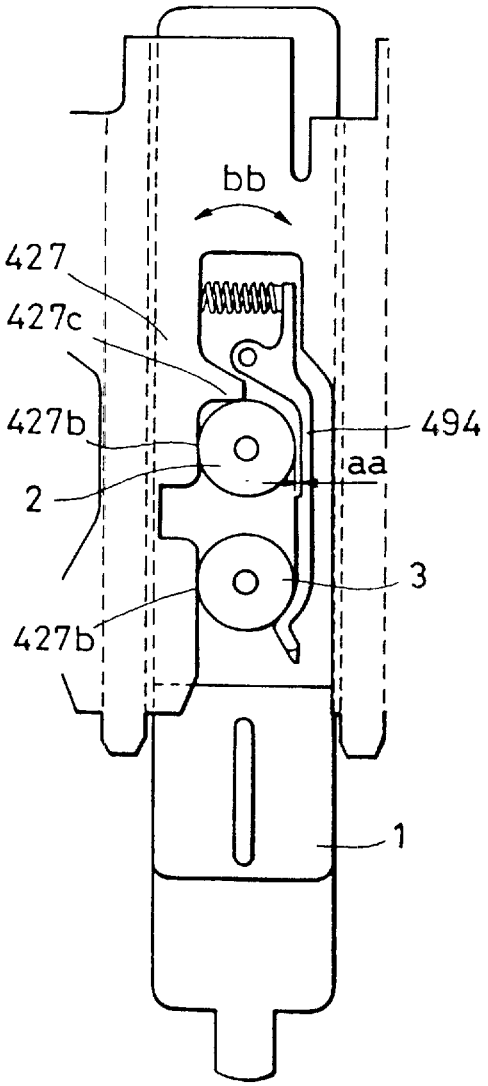
FIGS. 18A and 18B are sectional views of a principal part of an ink tank unit according to a third embodiment of the present invention.
Figure 18A:
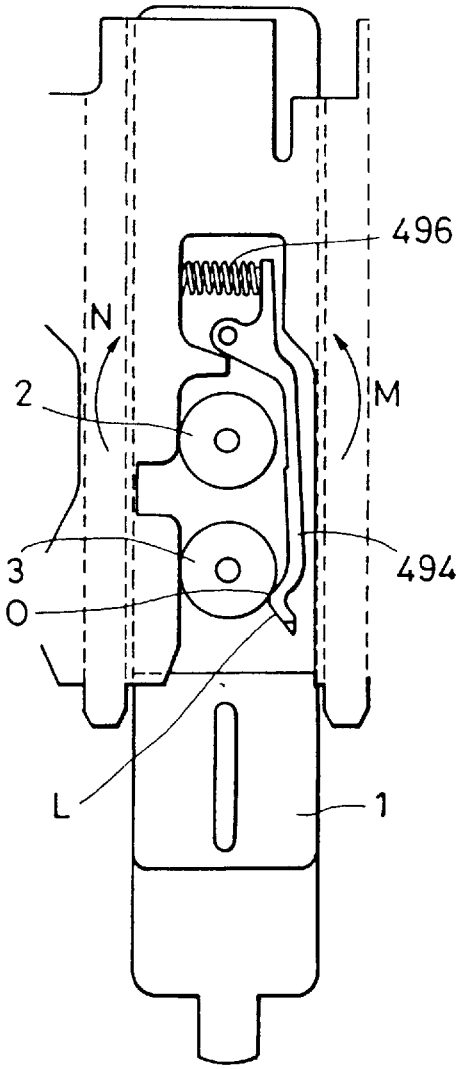

FIGS. 18A and 18B are sectional views of a principal part of an ink tank unit according to a third embodiment of the present invention; FIG. 18A shows a state where an ink tank is being inserted into the ink tank unit, and FIG. 18B shows a state after the insertion. This third embodiment differs from the above first and second embodiments in that a click member 494 has a different shape and a cap 3 in the form of a second projected portion and having an ink supply port is pressed by a compression spring 496.

In this embodiment, therefore, when inserting the ink tank, users sense a click feel twice before release of the needle movement preventing means.

Further, in this embodiment, an upper portion of the ink tank is finally positioned by pressing the first cap 2 to abut a lateral abutment surface 427*b*, as a second reference surface, and a perpendicular abutment surface 427*c*, as a first reference surface, of an upper guide 427 and pressing the second cap 3 to abut the lateral abutment surface 427*b* of the upper guide 427 (see FIG. 18B). In a state where the ink tank is completely positioned with the aid of the caps, therefore, the first cap in the form of the first projected portion is surrounded by the click member 495 and the lateral abutment surface 427*b* while leaving a gap aa between the first cap and the click member, as shown in FIG. 18B.

Accordingly, even if users tries to move the main tank 1 in a direction bb shown in FIG. 18B against the biasing force of a tank biasing spring (not shown), the main tank is only allowed to move through gap aa. By setting a size of the gap aa to be sufficiently small with design of shape of the click member, it is possible to restrict an amount of movement of the main tank 1 in the direction bb and to realize stable coupling between the ink tank and the ink tank unit.

Fourth Embodiment

Figure 19A:
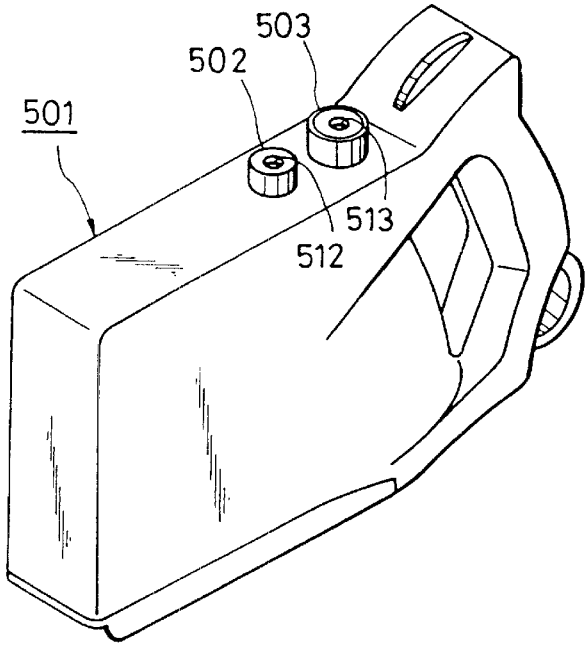
FIG. 19A is a three-dimensional perspective view of an ink tank according to a fourth embodiment of the present invention.
Figure 19B:
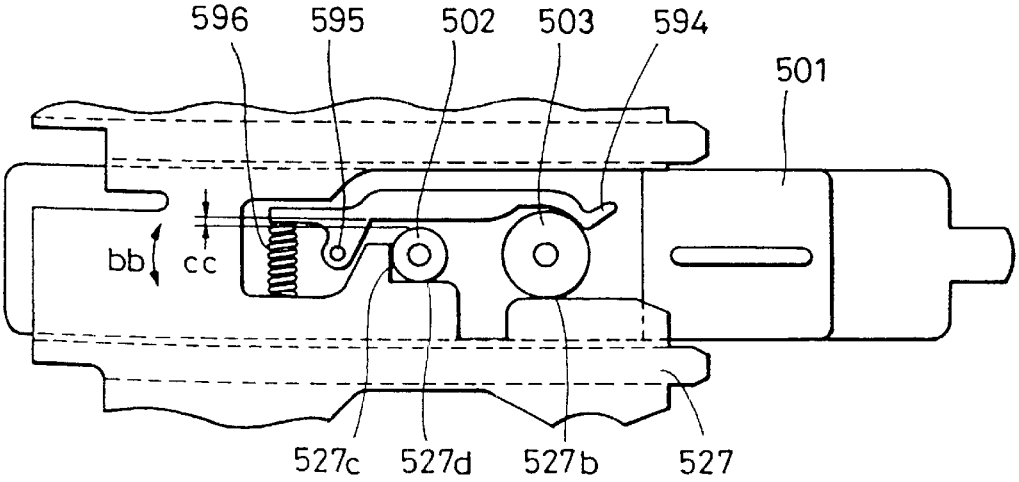
FIG. 19B is an explanatory view of a principal part of an ink tank unit according to the fourth embodiment.

FIGS. 19A and 19B show a fourth embodiment of the present invention; FIG. 19A is a three-dimensional perspective view of an ink tank to which the present invention is applied, and FIG. 19B is an explanatory view of a principal part of an ink tank unit. This fourth embodiment is modified from the above third embodiment in that a first cap 502 in the form of a first projected portion of an ink tank 501 has a different shape, and an ink tank unit is also modified to have first and second reference surfaces corresponding to the first projected portion.

As shown in FIG. 19A, the ink tank 501 of this embodiment has the first cap 502 in the form of the first projected portion which is cylindrical with a smaller diameter than a second cap 503 in the form of a second projected portion. The first and second caps 502, 503 have the same height similarly to the above first to third embodiments.

Then, as shown in FIG. 19B, an upper guide 527 of the ink tank unit is constructed such that a first reference surface 527*c* is configured to abut the first cap, and a second reference surface abutting the caps is divided into a portion 527*b* abutting the second cap and a portion 527*d* abutting the first cap. With this construction, an amount by which the first cap is allowed to move in the direction bb can be restricted to cc shown in FIG. 19B.

In this embodiment, the first cap 502 is smaller than the second cap 503 unlike the above third embodiment. Therefore, when the ink tank 501 is inserted, a click member 594 effects the click operation not on the first cap, but on the second cap only. As a result, comparing with the above third embodiment, users can more easily confirm upon one click operation that the tank has been positioned in the predetermined position. Further, since the amount cc by which the first cap is allowed to move can be set to be sufficiently small with design of shape of the click member, it is possible to restrict an amount of movement of the ink tank and to realize stable coupling between the ink tank and the ink tank unit as with the above third embodiment.

Fifth Embodiment

Figure 20A:
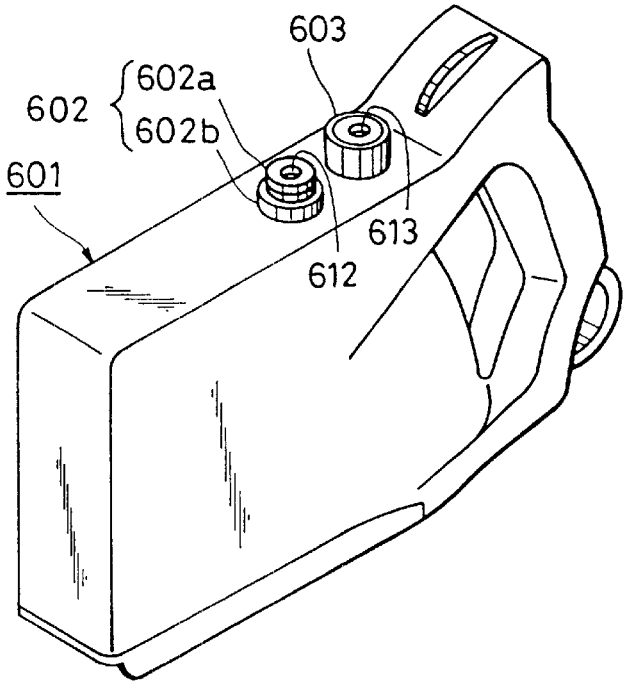
FIG. 20A is a three-dimensional perspective view of an ink tank according to a fifth embodiment of the present invention.
Figure 20B:
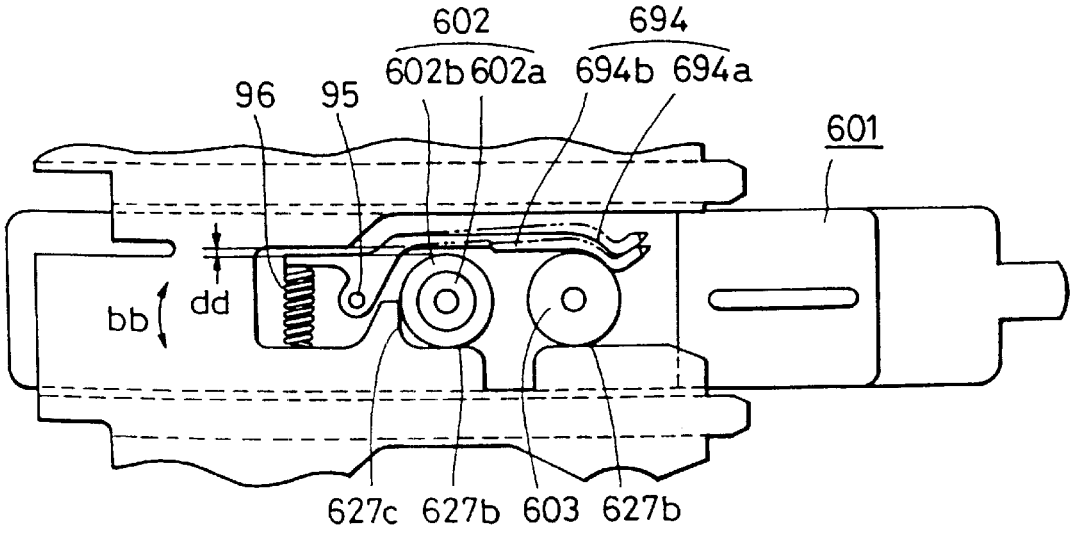
FIG. 20B is an explanatory view of a principal part of an ink tank unit according to the fifth embodiment.

FIGS. 20A and 20B show a fifth embodiment of the present invention; FIG. 20A is a three-dimensional perspective view of an ink tank to which the present invention is applied, and FIG. 20B is an explanatory view of a principal part of an ink tank unit. This fifth embodiment is modified from the above third embodiment in that a first cap 602 in-the form of a first projected portion of an ink tank 601 has a different shape, and an ink tank unit is also modified to have first and second reference surfaces corresponding to the first projected portion.

As shown in FIG. 20A, the ink tank 501 of this embodiment has the first cap 602 in the form of the first projected portion which comprises a cylinder 602*a* with a smaller diameter than a second cap 603 in the form of a second projected portion, and a cylinder 602*b* with the same diameter as the second cap 603, both the cylinders being arranged in a concentric relation (the cylinder 602*b* being located on the base side). The first and second caps 602, 603 have the same height similarly to the above embodiments.

Then, as shown in FIG. 20B, an upper guide 627 of the ink tank unit is constructed to have a first reference surface 627*c* abutting the first cap, and a second reference surface 627*b* abutting the first and second caps. With this construction, an amount by which the first cap 602 is allowed to move in the direction bb can be restricted to dd shown in FIG. 20B. Also, in this embodiment, a click member 694 comprises an end portion 694*a* and an arm portion 694*b* which are located in the vertical direction corresponding to only the cylinder 602*a* and to both the cylinders 602*a*, 602*b*, respectively. This means that when the first cap 602 passes the end portion 694*a*, the click member 594 effects no click operation.

In this embodiment, as with the above fourth embodiment, when the ink tank 601 is inserted, the click member 694 effects the click operation not on the first cap, but on the second cap only. Thus, users can more easily confirm upon one click operation that the tank has been positioned in the predetermined position. Further, in this embodiment, the amount dd by which the first cap is allowed to move is given as a distance between the arm portion of the click member 694 and the cylinder 602*a* of the first cap, and can be set to be sufficiently small as with the above third and fourth embodiments. It is hence possible to restrict an amount of movement of the ink tank and to realize stable coupling between the ink tank and the ink tank unit.

Sixth Embodiment

Figure 21A:
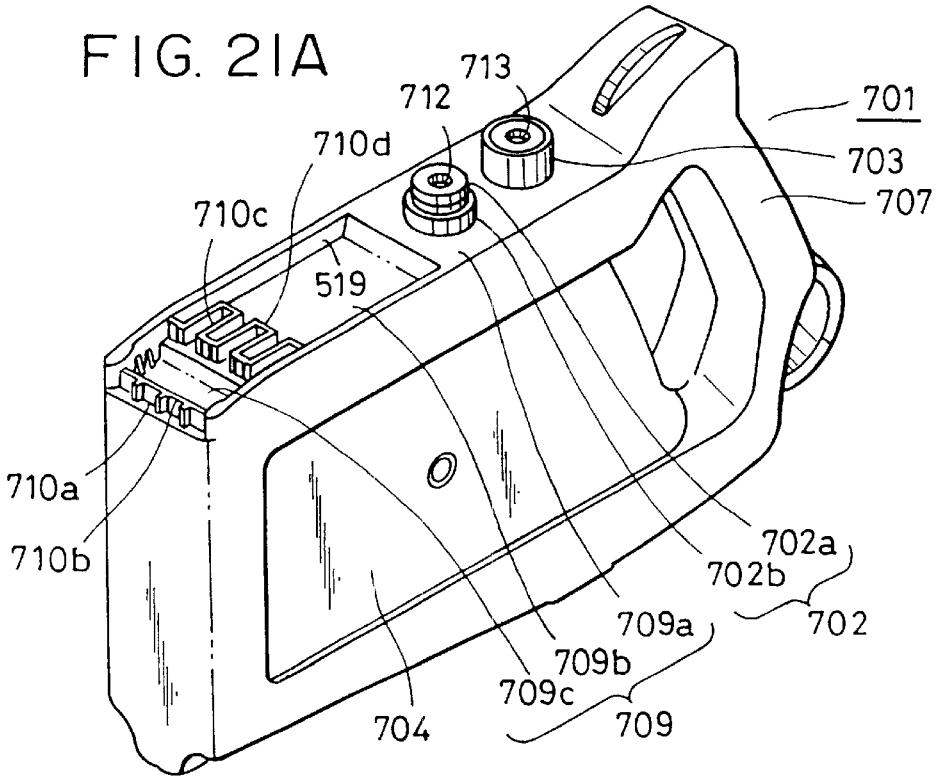
FIGS. 21A and 21B are three-dimensional perspective views for explaining an ink tank according to a sixth embodiment of the present invention.
Figure 21B:
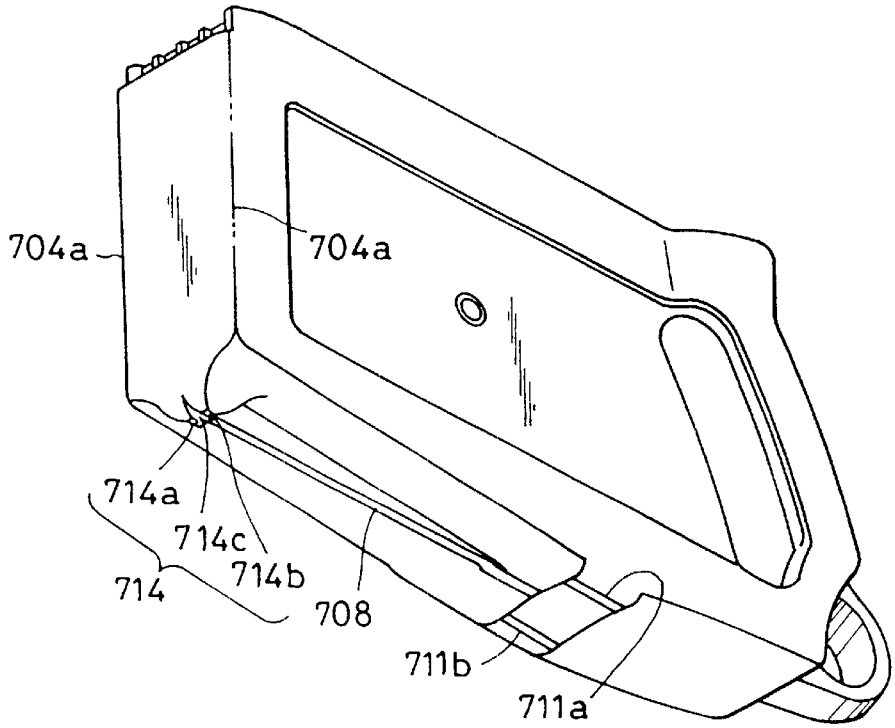

FIGS. 21 and 22 show an ink tank according to a sixth embodiment of the present invention. Specifically, FIGS. 21A and 21B are explanatory views for explaining the ink tank according to the sixth embodiment of the present invention; FIG. 21A is a three-dimensional perspective view of the ink tank in a state where a connection portion to needles of an ink tank unit are positioned at the top (i.e., in a posture during use), and FIG. 21B is a three-dimensional perspective view for explaining a bottom surface of the ink tank.

This sixth embodiment differs from the above fifth embodiment in shapes of a bottom surface and a top surface (where the first and second projected portions are provided) of the ink tank and arrangement of the wrong attachment preventing member.

A top surface 709 of an ink tank 701 of this sixth embodiment includes flat surfaces 709*a*, 709*b*, 709*c* lying at different levels. A first projected portion 702 having an atmosphere communicating port 712 and a second projected portion 703 having an ink supply port 713 are provided on the flat surface 709*a* which locates farest from the bottom when the ink tank is coupled to the ink tank unit. A second wrong attachment preventing portion 710*c*, 710*d* is provided on the flat surface 709*b* which is adjacent to the flat surface 709*a* and is one step lower than the flat surface 709*a*. A first wrong attachment preventing portion 710*a*, 710*b* is provided on the flat surface 709*c* which is one step lower than the flat surface 709*b* and is positioned at a front end in the direction of insertion of the ink tank into the ink tank unit.

The first wrong attachment preventing portion provided at the front end of the ink tank in the direction of insertion thereof comprises four pawls 710*b* and protective walls 710*a* provided to extend parallel to the lengthwise direction of the ink tank (in the direction of insertion of the ink tank into the ink tank unit) for protecting the pawls 710*b*. By removing an unnecessary portion, the ink tank is prevented from being attached falsely to the ink tank unit. In the illustrated embodiment, the first wrong attachment preventing portion is adaptable for four types of ink tanks by removing three of the total four pawls. As with the first wrong attachment preventing portion, the second wrong attachment preventing portion comprises pawls 710*d* and protective walls 710*c*. In the illustrated embodiment, the second wrong attachment preventing portion includes a total of six pawls provided in two rows, and are adaptable for twenty types of ink tanks by removing three of the total six pawls. Thus, this embodiment is adaptable for eighty (20×4) types of ink tanks in combinations of the first and second wrong attachment preventing portions. However, the number of pawls of each wrong attachment preventing portion is not limited to the above-mentioned value, but it can be freely selected depending on the number of types of ink tanks required.

Although the flat surfaces 709*b* and 709*c* are located lower than the flat surface 709*a* in a state shown in FIG. 21A, side walls 719 are formed at both sides of the flat surfaces 709*b* and 709*c* to have a height substantially even with the flat surface 709*a*. Since the wrong attachment preventing portions 710*a*, 710*b*, 710*c*, 710*d* are formed to be even with or lower than the side walls 719 in the state shown in FIG. 21A, the first and second wrong attachment preventing portions are protected by the side walls 719 even if users should drop the ink tank inadvertently.

Further, since the first wrong attachment preventing portion is formed in a plane one step lower than a plane where the second wrong attachment preventing portion is formed, an identifying member in the form of projections provided on the ink tank unit side for identifying the second wrong attachment preventing portion will not interfere with the first wrong attachment preventing portion. Also, since the second wrong attachment preventing portion provided on the plane one step lower than a plane where the first and second projected portions are provided, the reference surfaces and the coupling members, which are provided on the ink tank unit for positioning and coupling the ink tank, will not interfere with the second wrong attachment preventing portion. Accordingly, the ink tank can be smoothly inserted, and by effectively utilizing a dimension of the ink tank in the vertical direction, identification of many types of ink tanks, i.e., identification of ink tanks depending on colors or recording apparatus onto which the ink tans are to be mounted, can be achieved without increasing the width of the ink tank (in a direction perpendicular to the direction of insertion of the ink tank). While the wrong attachment preventing portion is provided in two steps in this embodiment, it may be provided in only one step when the types of ink tanks to be identified are a few.

The shape of the bottom surface of the ink tank according to this embodiment will now be described below.

In this embodiment, as shown in FIG. 21B, the bottom surface includes projections 711*a*, 711*b*, 714 and a reinforcing rib 708 projecting by a smaller amount than the projections. The projections 711*a*, 711*b* are provided to extend near and along lateral surfaces 704 opposing to each other in a parallel relation, and the projection 714 is provided at a front end of the ink tank in the direction of insertion thereof in a central portion spaced from the opposing lateral surfaces 704 by an equal distance. The reinforcing rib 708 is provided in a central portion spaced from the opposing lateral surfaces 704 by an equal distance and is extended from the projection 714 to a position near the projections 711*a*, 711*b*.

Incidentally, since the ink tank of this embodiment is manufactured by blowing, a central portion 714*c* of the projection 714 is recessed from the projections 714*a*, 714*b* so that burrs will not remain on the projection 714 during the blowing process. The projections 714*a*, 714*b* can be however dealt as one projection 714 because the distance between the projections 714*a*, 714*b* is smaller than that between the projections 711*a*, 711*b*.

Figure 22A:
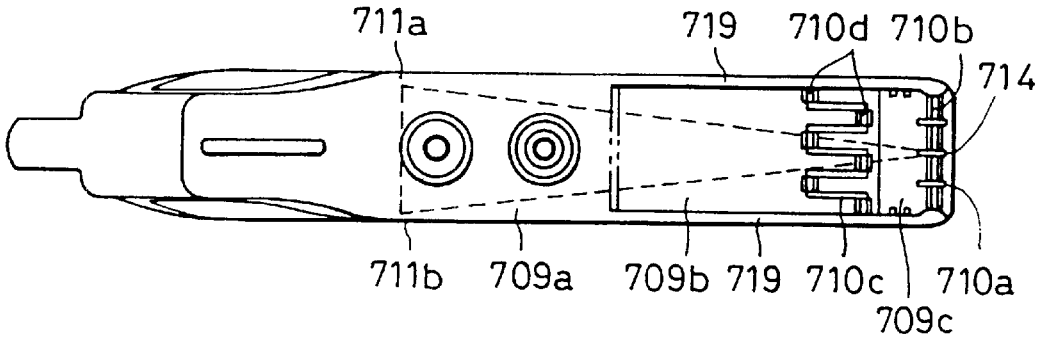
FIG. 22A is a plan view of the ink tank according to the sixth embodiment of the present invention.

In the ink tank of this embodiment, as shown in FIG. 22A which is a plan view of the ink tank, the atmosphere communicating port 712 and the ink supply port 713 are provided in an area of the top surface opposing to an area (triangle) defined by lines connecting the three projections 714, 711*a*, 711*b*. Particularly, in this embodiment, the projection 714 is provided at the front end of the ink tank in the direction of insertion thereof in the central portion spaced from the opposing lateral surfaces 704 by an equal distance, and the ink tank has a symmetrical shape with respect to a section taken along the center line extending from the projection 714 (denoted by a one-dot-chain line in FIG. 22A) except the wrong attachment preventing portions. Then, the atmosphere communicating port 712 and the ink supply port 713 have the centers lying on the section.

Furthermore, the ink tank of this embodiment can contain ink in the grip portion as well, but the center of gravity of the ink tank in its posture during use, shown in FIG. 21A, locates in the area defined by the three projections shown in FIG. 22A, as viewed from the top, regardless of whether ink is contained in the tank.

Figure 22B:
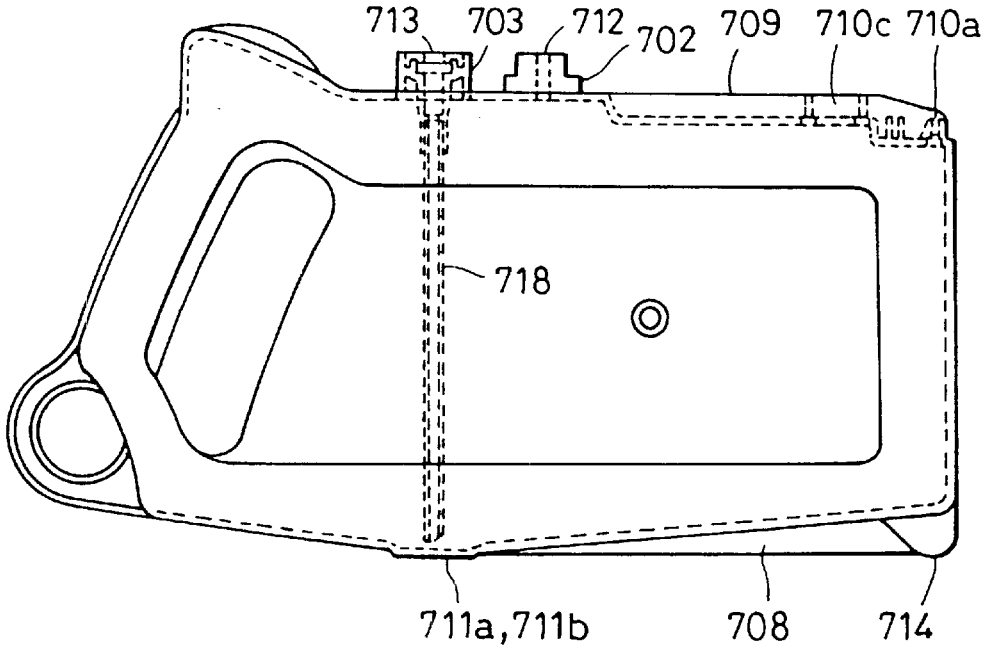
FIG. 22B is a side view of the ink tank according to the sixth embodiment of the present invention.

Also, since the ink tank of this embodiment is manufactured by blowing, inner surfaces of the tank housing have a shape corresponding to outer surfaces thereof except the wrong attachment preventing portions, the atmosphere communicating port and the ink supply port, as denoted by dotted lines in a side view shown in FIG. 22B. In this embodiment, areas of the bottom surface, in which the grip portion and the reinforcing rib are provided, are formed to provide slopes on the inner side. Thus, the bottom surface has the lowest level near an area in which the projections 711*a*, 711*b* are provided.

Additionally, as shown in FIG. 22B, a tube 18 is extended from the ink supply port to a position near the inner bottom of the tank housing. With the tube 18 connected to the ink supply port and subjected to suction from the exterior, ink contained in the tank housing can be positively led out to the exterior even in the posture shown in FIG. 21A, and hence an amount of ink remaining wastefully in the tank housing can be reduced.

Figure 23:
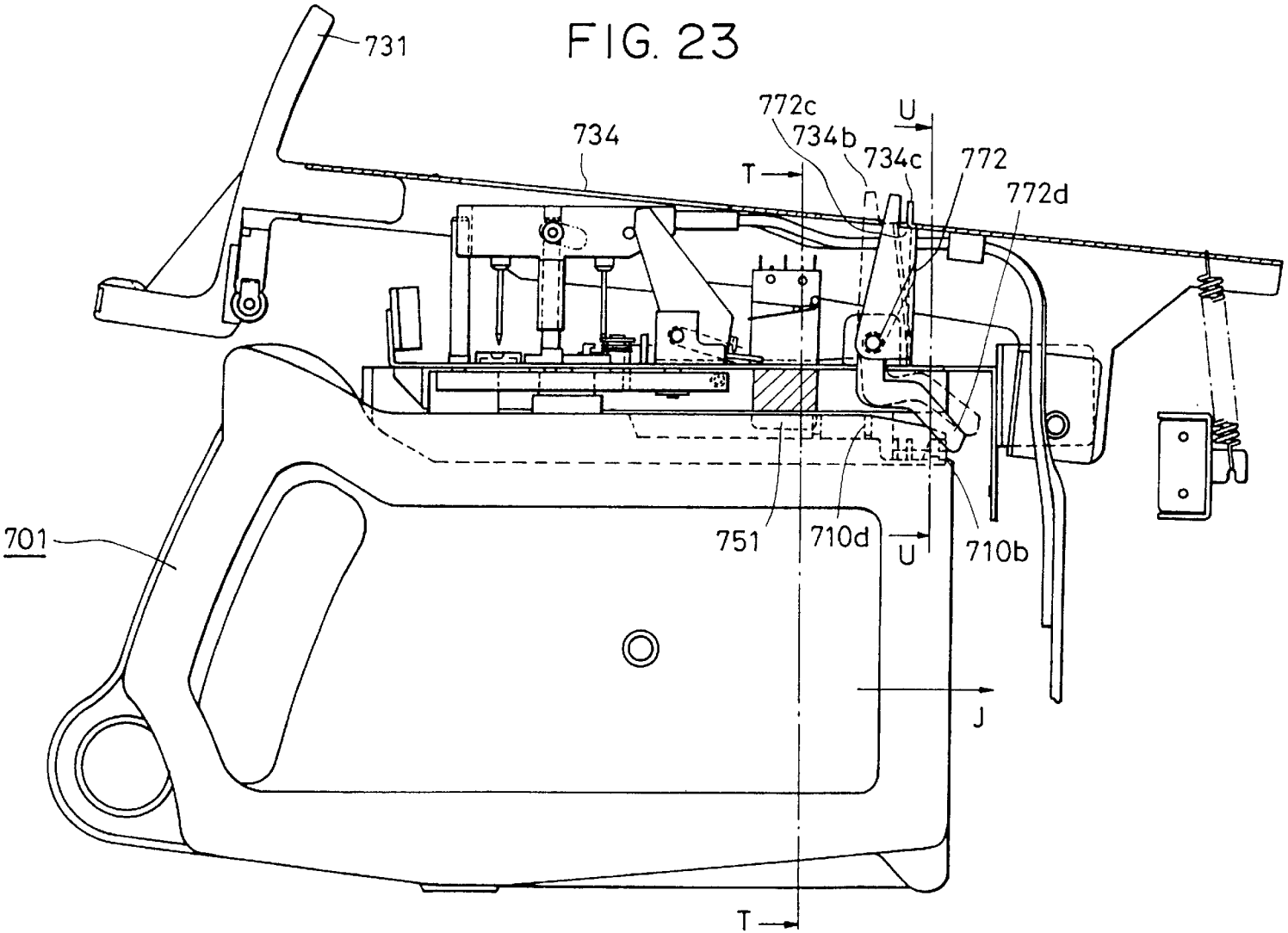
FIG. 23 is an explanatory view of a principal part of an ink tank unit according to the sixth embodiment.
Figure 24A:
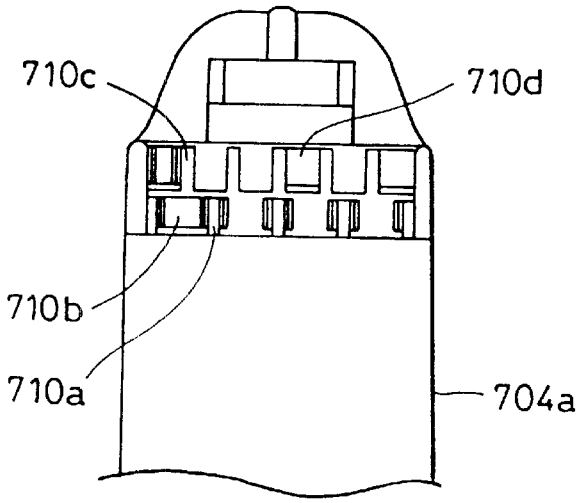
FIGS. 24A to 24C are explanatory views for explaining a mechanism for preventing wrong attachment between the ink tank and the ink tank unit according to the sixth embodiment of the present invention.
Figure 24B:
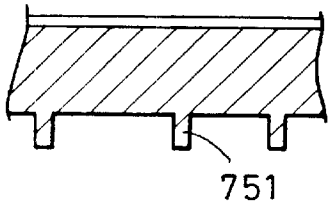
Figure 25:
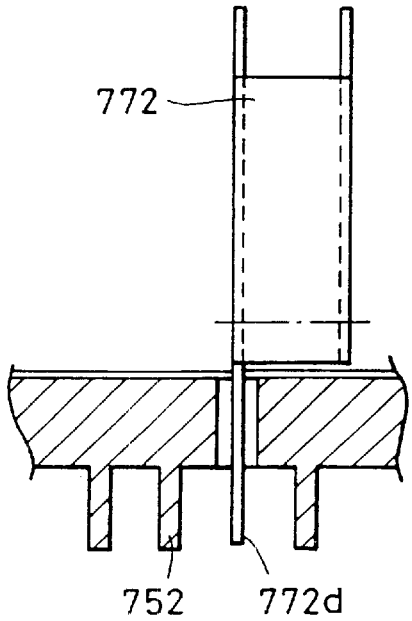
FIG. 25 is an explanatory view for explaining the mechanism for preventing wrong attachment between the ink tank and the ink tank unit according to the sixth embodiment of the present invention.
Figure 26A:
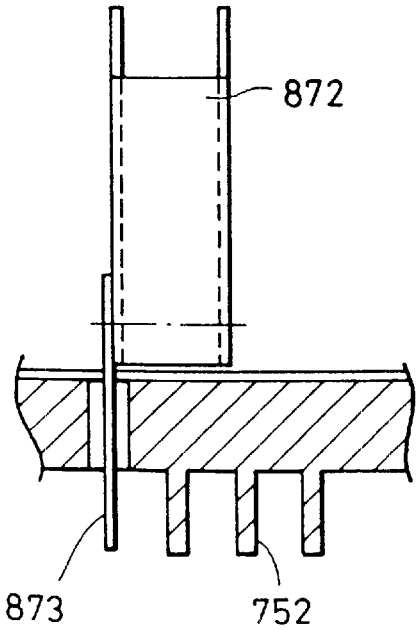
FIGS. 26A and 26B are explanatory views for explaining a modification of the ink tank unit according to the sixth embodiment of the present invention.
Figure 26B:
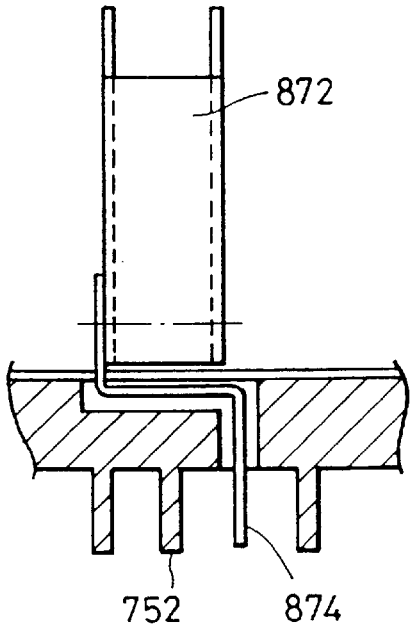

Next, the ink tank unit according to the sixth embodiment of the present invention will be described with reference to FIGS. 23 to 26. FIG. 23 is an explanatory view of a principal part of the ink tank unit according to this embodiment, FIGS. 24 and 25 are explanatory views for explaining a mechanism for preventing wrong attachment between the ink tank and the ink tank unit, and FIG. 26 is an explanatory view for explaining a modification of the ink tank unit. Specifically, FIGS. 24A and 24C are sectional views taken along T—T in FIG. 23, while FIGS. 24B, 25, 26A and 26B are sectional views taken along U—U in FIG. 23.

Figure 24C:
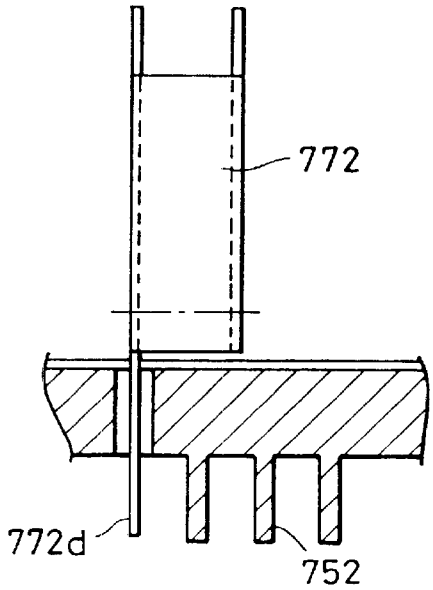

The ink tank unit of this embodiment differs from the above-described ink tank unit in that a first identifying member 751 in the form of projections, shown in FIG. 24B, is provided in a position coming into abutment with the first wrong attachment preventing portion, and a second identifying member 752 in the form of projections, shown in FIG. 24C, and a foot portion 772*d* of a lever lock member 772 are provided in a position coming into abutment with the second wrong attachment preventing portion.

The ink tank unit of the illustrated embodiment is constructed to allow insertion of only such one of ink tanks having the above-described construction that three pawls 710*d* corresponding to the first identifying member 751 and one pawl 710*b* corresponding to the second identifying member 752 are cut out, whereas the pawl 710*b* corresponding to the foot portion 772*d* of the lever lock member 772 and the second, third and fifth pawls 710*d* counted from the left end are left.

Accordingly, when the ink tank 701 is inserted, the foot portion 772*d* of the lever lock member 772 is pushed by the corresponding left pawl 710*b*, whereupon the lever lock member 772 is rotated counterclockwise about a support shaft 773 to a position denoted by dotted lines shown in FIG. 23. With this rotation, a shoulder portion (lock portion) 772*c* of the lever lock member 72 is disengaged from a bent portion (receiving portion) 734*c* provided on a lever body 734, and then moves to a position just corresponding to an opening 734*b*. As a result, the lever body 734 is released from a condition locked by the lever lock member 772, allowing a lock lever 731 be moved downward.

If an ink tank having the pawls 710*b*, 710*d* remained in the positions corresponding to the first and second identifying members is inserted by a mistake, the ink tank cannot be fully inserted because the pawls strike against the first identifying member 751 and the second identifying member 752. Users can therefore notice that a wrong ink tank has been inserted. For an ink tank 701 in which all the pawls 701*b* and 710*d* are cut out, the ink tank can be fully inserted, but the lever lock member 772 is not rotated. Hence, the lock lever 731 is prevented from being moved downward falsely.

Because of having two wrong attachment preventing portions, this embodiment is adaptable for preventing wrong attachment of many types of ink tanks. Also, since the lever body 734 is unlocked upon the pawl 710*b* rotating the lever lock member 772, this embodiment can provide an advantage that wrong attachment of ink tanks can be avoided more positively.

While the above description is made in connection with the case where the foot portion 772*d* of the lever lock member 772 locates in a position corresponding to the leftmost pawl 710*b*, the foot portion 772*d* may of course locate in another position. FIG. 25 shows the case where the foot portion 772*d* locates in a position corresponding to the third pawl 710*b* counted from the left end.

However, if the lever lock member 772 is displaced in its entirety as shown in FIG. 25, a number of associated parts disposed around the lever lock member 772 must be modified correspondingly. Since the lever lock member 772 can take any of four positions in the embodiment, it is also required to prepare four types of associated parts. Such an increase in number of parts can be avoided by constructing the lever lock member from two parts, i.e., a common portion 872 and a foot portion 873 or 874, as shown in FIGS. 26A and 26B. When the foot portion is moved to another position, the foot portion 874 is attached instead of the foot portion 873 as shown in FIG. 26B. As a result, the common portion 872 of the lever lock member is not required to be displaced, and hence the associated parts can be used in common.

Further, in this embodiment, since the atmosphere communicating port 712 and the ink supply port 713 are provided in the area of the top surface opposing to the area (triangle) defined by lines connecting the three projections 714, 711*a*, 711*b*, a force generated upon the insertion of the needles of the ink tank unit can be positively borne by the three projections 714, 711*a*, 711*b* rather than the entire bottom surface. It is hence possible to minimize deformation of the ink tank caused upon the insertion of the needles of the ink tank unit. Moreover, since upon the insertion of the needles is less affected by product variations of ink tanks, deformation or bending of the needles can be avoided more positively.

Particularly, in this embodiment, the projection 714 is provided at the front end of the ink tank in the direction of insertion thereof in the central portion spaced from the opposing lateral surfaces 704 by an equal distance, and the ink tank has a symmetrical shape with respect to the section taken along the center line extending from the projection 714 (denoted by the one-dot-chain line in FIG. 22A) except the wrong attachment preventing portions. Then, the atmosphere communicating port 712 and the ink supply port 713 have the centers lying on the section. This arrangement provides improved stability of the ink tank in its coupled condition.

The ink supply port and the atmosphere communicating port may be positioned in a not exactly opposed relation to the center line so long as they locate in the area of the top surface opposing to the area defined by the three projections. In this embodiment, since the projections 711*a*, 711*b* are provided in symmetrical relation near a position opposing to the ink supply port, the force generated upon the coupling of the ink tank can be borne in a more stable manner.

Additionally, in this embodiment, with the provision of the reinforcing rib 708, the relative positional relationship between the projections is prevented from changing due to deformation when the force generated upon the insertion of the needles is borne by the projections, and such an attachment trouble as catching of the projections by parts on the ink tan unit side can be avoided during the insertion of the ink tank into the ink tank unit.

Figure 27B:
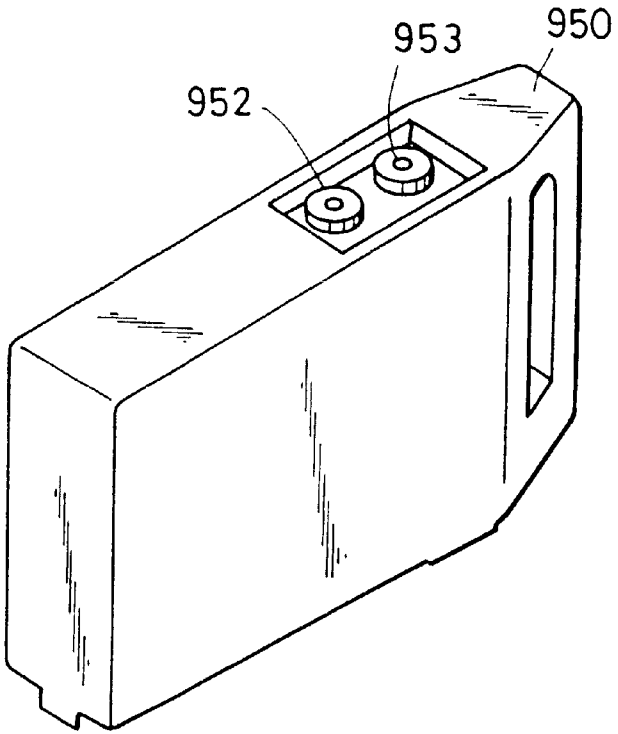
FIGS. 27A and 27B are three-dimensional perspective views for explaining modifications of the ink tank according to the sixth embodiment of the present invention.
Figure 27A:
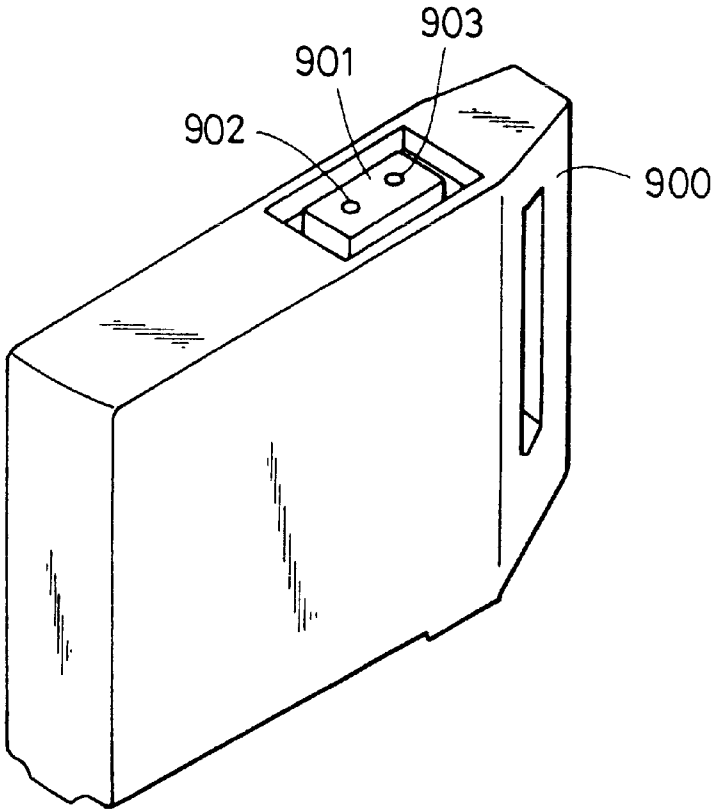

While, in any of the above embodiments, the ink tank includes a projected portion as a coupling portion to the ink tank unit, the projected portion is not necessarily projected above the top surface of the tank depending on design of the ink tank unit. FIGS. 27A and 27B are perspective views showing modifications of the ink tank according to the sixth embodiment. In the above embodiments, the coupling portion has been described as projecting above the top surface. In the modifications, a recess is formed in the top surface and a projected portion is provided in the recess such that an upper end of the projected portion is flush with the top surface.

FIG. 27A shows an ink tank 900 in which an ink supply port 903 and an atmosphere communicating port 902 are both provided in one projected portion 901. FIG. 27B shows an ink tank 950 in which an ink supply port and an atmosphere communicating port are provided in two separate projected portions 952, 953, respectively. These modifications provide such an advantage that the ink tank has the shape of a substantially rectangular parallelepiped, and hence can be transported with higher space efficiency.

In an ink tank unit corresponding to the modified ink tanks, a click feel is produced by utilizing the recess around the projected portion(s), and the ink tank is positioned by utilizing an outer periphery of at least one projected portion. When manufacturing the ink tank by blowing, the projected portion may be manufactured in the form of a cap comprising several members.

As described above, in a method of coupling an ink tank and an ink tank unit according to the present invention, an ink supply needle is inserted after the ink tank has been fixedly held. Therefore, the coupling method is provided which can reduce damage of needles and hence has high reliability.

Also, since the needle is inserted substantially perpendicularly to the direction of insertion of the tank, there occurs no force component in a direction opposing to the direction of insertion of the tank, in which the tank is more likely to shift upon the insertion of the needle while the tank is positioned. Hence, the ink tank is prevented from shifting upon the insertion of the needle and reliability of the operation is further improved. In particular, since the needle is inserted vertically from above, an ink supply port and an atmosphere communicating port of the tank can be provided on a top surface (surface opposing to a bottom surface) of the tank. Consequently, even if the needle should be inserted falsely, there is no fear that ink may leak.

In the operation of inserting the ink tank, a needle moving means is not released by a wrong tank because a wrong attachment preventing means is provided on the front side in the direction of insertion of the ink tank. It is therefore possible to surely prevent the wrong attachment and improve reliability of the coupling between the ink tank and the ink tank unit.

Further, since two or more types of needle movement preventing means are provided, the needle is avoided from being damaged inadvertently even if one of the needle movement preventing means should malfunction. In addition, the needle movement preventing means can be constructed to have increased strength.

The needle is inserted after a lever as the needle moving means has urged a vertical surface portion of the ink tank in a direction to abut a reference surface, against which the ink tank is to be fixedly held, thereby positioning the ink tank more positively. As a result, reliability of the coupling is further improved.

With the ink tank, the ink tank unit, and the method of coupling them according to the present invention, since the needle is inserted substantially perpendicularly to the direction of insertion of the tank, there occurs no force component in a direction opposing to the direction of insertion of the tank, in which the tank is more likely to shift upon the insertion of the needle while the tank is positioned. Hence, the ink tank is prevented from shifting upon the insertion of the needle and reliability of the operation is further improved.

In particular, since the needle is inserted vertically from above, the ink supply port and the atmosphere communicating port of the tank can be provided on the top surface (surface opposing to the bottom surface) of the tank. Accordingly, even if the needle should be inserted falsely, there is no fear that ink may leak.

Also, since the ink tank is positioned with the aid of a projected portion which serves as a coupling portion to a recording apparatus, it is possible to increase positional accuracy of the coupling portions of the ink tank and the ink tank unit and to improve reliability of the coupling by increasing accuracy of a part of the tank, i.e., the projected portion, rather than accuracy of the entire tank.

When coupling an ink tank having a plurality of projected portions, one of the projected portions is abutted with a first reference surface, and at least two projected portions are abutted with a second reference surface. As a result, in an ink jet recording apparatus which employs inks of multiple colors, the ink tank can be prevented from wobbling in the direction of insertion thereof and more positive coupling can be realized without wasteful use of a space.

Further, according to the ink tank of the present invention, even if the ink tank should be dropped, a second cap having an ink supply port is prevented from directly contacting the ground and is protected by the presence of the vertical surface portion and a first cap having an atmosphere communicating port. Therefore, an ink tank is provided which can be more reliably coupled to a recording apparatus capable of mounting the ink tank on it.

Moreover, according to the ink tank of the present invention, since the lengthwise direction of the ink tank is aligned with the direction of insertion of the ink tank into an ink jet recording apparatus, an ink tank is provided which is adaptable for an ink jet recording apparatus employing inks of multiple colors without wasteful use of a space. For an ink tank provided with a plurality of projected portions, particularly, the ink tank can be used in the recording apparatus employing inks of multiple colors with high space efficiency.

Also, since a wrong attachment preventing member for preventing wrong attachment of the ink tank is provided forwardly of-the projected portions of the ink tank in the direction of insertion thereof, the wrong attachment is detected before positioning of the tank, and hence the ink tank is more positively prevented from being attached falsely.

While, in the illustrated embodiments, the ink tank includes two coupling portions, i.e., the ink supply port and the atmosphere communicating port, the number of coupling portions is not limited to two in the coupling method and the recording apparatus according to the present invention. The number of coupling portions may be one or three or more depending on the structure of the ink tank. Additionally, the number of ink tanks received in the ink tank unit may be plural as with the illustrated embodiments, or one.

What is claimed is:

1. An ink tank including an ink containing portion for containing ink, said ink tank comprising:

a substantially cylindrical first projected portion having a communicating portion for communicating said ink containing portion with the exterior, and a substantially cylindrical second projected portion having a communicating portion for leading out the ink in said ink containing portion to the exterior, said first and second projected portions being both provided on a surface opposing to a bottom surface of said ink tank, a grip portion provided at a rear end of said ink tank in the direction of insertion thereof, and a vertical surface portion extending upward from said grip portion perpendicularly to the bottom surface of said ink tank in an opposed relation to said first and second projected portions, said second projected portion being provided in an area between said vertical surface portion and said first projected portion, said vertical surface portion having an upper end at a higher level from the bottom surface than end faces of the communicating portions of said first and second projected portions, said second projected portion being positioned at a level lower than a line connecting the upper end of said vertical surface portion and the end face of the communicating portion of said first projected portion.

2. An ink tank according to claim 1, wherein a slope is provided between said vertical surface portion and the surface opposing to said bottom surface, and a rib is provided on said slope.

3. An ink tank including an ink containing portion for containing ink, said ink tank comprising:

a bottom surface provided with three projections for supporting said ink tank through contact with a flat plane when said ink tank is placed on the flat plane, a top surface opposed to said bottom surface and having an ink supply portion for leading out the ink in said ink containing portion to the exterior, a plurality of lateral surfaces adjacent to said bottom surface and said top surface, said plurality of lateral surfaces including one set of opposing surfaces extended in a lengthwise direction of said ink tank, and a grip portion provided on a surface adjacent to each of said top surface, bottom surface and the opposing surfaces of said one set of opposing surfaces, wherein two of said three projections are provided in an opposed relation in areas near the opposing surfaces of said one set of opposing surfaces, said ink supply portion being provided opposing to an area located on or within lines connecting said three projections.

4. An ink tank according to claim 3, wherein said bottom surface is inclined to provide a lowest surface thereof near the area including said two projections, and further comprising a supply tube extending from said ink supply portion toward the lowest bottom surface.

5. An ink tank according to claim 3, further comprising an atmosphere communicating portion for communicating said ink containing portion with the exterior provided in an area of said top surface opposing to the area locating on or within the lines connecting said three projections.

6. An ink tank according to claim 5, wherein said top surface is provided with a first projected portion including said atmosphere communicating portion, a second projected portion including said ink supply portion and being separate from said first projected portion, and a wrong attachment preventing portion for identifying the type of said ink tank, said wrong attachment preventing portion being provided at an end of said ink tank opposed in the lengthwise direction thereof to said grip portion, said atmosphere communicating portion and said ink supply portion being both provided above said wrong attachment preventing portion.

7. An ink tank according to claim 5, wherein the remaining one projection on said bottom surface side is provided near a central portion spaced from the opposing surfaces of said plurality of lateral surfaces by an equal distance, and said ink supply port and said atmosphere communicating port are provided in an area of said top surface opposed to the area located on or within lines connecting said three projections and opposed to the center line extending from the remaining one projection provided near the central portion.

8. An ink tank according to claim 7, further comprising said remaining one projection provided near the central portion is provided near an end opposite to said grip portion.

9. An ink tank according to claim 7, further comprising a rib projecting by a smaller amount than said three projections and provided on said bottom surface in the area located on or within the lines connecting said three projections and on the center line extending from said remaining one projection provided near the central portion.

* * * * *

UNITED STATES PATENT AND TRADEMARK OFFICE

CERTIFICATE OF CORRECTION

PATENT NO. : 6,431,699 B2
DATED : August 13, 2002
INVENTOR(S) : Makoto Shihoh et al.

It is certified that error appears in the above-identified patent and that said Letters Patent is hereby corrected as shown below:

Title page,
Item [75], Inventors, "Kyoto Miyazaki" should read -- Kyota Miyazaki --;
Item [56], References Cited, U.S. PATENT DOCUMENTS,
"5,168,291 12/1992 Hramatsu et al." should read -- 5,168,291 12/1992 Hiramatsu et al --; and "6,276,789 8/2001 Miyazawa et al." should read -- 6,276,789 4/2001 Miyazaki et al. --; and
Item [57], ABSTRACT,
Line 4, "exterior should read -- exterior, --.

Column 1,
Line 25, "replaced-when" should read -- replaced when --; and
Line 38, "taking in" should read -- taken in --.

Column 3,
Line 44, "falsely." should read -- incorrectly --.

Column 5,
Line 23, "even" should read -- event --; and
Line 50, "thereof," should read -- of --.

Column 9,
Line 6, "matters" should read -- matter --.

Column 10,
Line 7, "lowers" should read -- becomes lower --.

Column 14,
Line 25, "polypropyrene." should read -- polypropylene. --.

Column 16,
Line 29, "FIG.1 1A" should read -- FIG. 11A --.

Column 18,
Line 44, "locates" should read -- is located --; and

Column 20,
Line 48, "can be given" should read -- are provided --.

UNITED STATES PATENT AND TRADEMARK OFFICE

CERTIFICATE OF CORRECTION

PATENT NO. : 6,431,699 B2
DATED : August 13, 2002
INVENTOR(S) : Makoto Shihoh et al.

It is certified that error appears in the above-identified patent and that said Letters Patent is hereby corrected as shown below:

Column 22,
Line 2, “in-the” should read -- in the --; and
Line 63, “farest” should read -- farthest --.

Column 23,
Line 56, “tans” should read -- tanks --.

Column 26,
Line 46, “tan” should read -- tank --.

Column 30,
Line 4, “locating” should read -- located --.

Signed and Sealed this

Third Day of June, 2003

JAMES E. ROGAN
*Director of the United States Patent and Trademark Office*